US010512830B2

(12) United States Patent
Nicolette et al.

(10) Patent No.: US 10,512,830 B2
(45) Date of Patent: Dec. 24, 2019

(54) GOLF CLUB GRIPS AND METHODS TO MANUFACTURE GOLF CLUB GRIPS

(71) Applicant: Parsons Xtreme Golf, LLC

(72) Inventors: Michael R. Nicolette, Scottsdale, AZ (US); Caleb S. Kroloff, Scottsdale, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 15/960,141

(22) Filed: Apr. 23, 2018

(65) Prior Publication Data

US 2018/0311548 A1 Nov. 1, 2018

Related U.S. Application Data

(60) Provisional application No. 62/491,095, filed on Apr. 27, 2017.

(51) Int. Cl.

| | |
|---|---|
| ***A63B 53/14*** | (2015.01) |
| ***A63B 53/08*** | (2015.01) |
| ***A63B 60/24*** | (2015.01) |
| *A63B 53/04* | (2015.01) |
| *A63B 102/32* | (2015.01) |
| *A63B 53/00* | (2015.01) |
| *A63B 60/02* | (2015.01) |

(52) U.S. Cl.

CPC ..... *A63B 53/08* (2013.01); *A63B 53/14* (2013.01); *A63B 60/24* (2015.10); *A63B 53/007* (2013.01); *A63B 53/0487* (2013.01); *A63B 60/02* (2015.10); *A63B 2053/0433* (2013.01); *A63B 2053/0441* (2013.01); *A63B 2102/32* (2015.10)

(58) Field of Classification Search

CPC ..... A63B 60/14; A63B 53/14; A63B 53/08; A63B 53/007; A63B 2102/32; A63B 2053/0441; A63B 60/24; A63B 2053/0433; A63B 60/02; A63B 53/0487

See application file for complete search history.

(56) References Cited

U.S. PATENT DOCUMENTS

| | | | | |
|---|---|---|---|---|
| D196,268 | S * | 9/1963 | Lamb | D8/107 |
| 3,252,706 | A | 5/1966 | Rosasco | |
| 3,606,326 | A | 9/1971 | Sparks et al. | |
| 4,461,479 | A | 7/1984 | Mitchell | |
| 4,746,120 | A | 5/1988 | Mockovak | |
| 4,826,168 | A | 5/1989 | McGuire et al. | |
| 4,878,667 | A | 11/1989 | Tosti | |
| 5,087,042 | A | 2/1992 | Solheim | |
| 5,169,152 | A | 12/1992 | Marquardt | |
| 5,322,290 | A | 6/1994 | Minami | |
| 5,575,473 | A | 11/1996 | Turner | |
| 6,004,224 | A * | 12/1999 | Tanaka | A63B 53/10 473/297 |
| D464,694 | S * | 10/2002 | Moore | D21/756 |
| 6,511,386 | B1 * | 1/2003 | Cacicedo | A63B 49/08 473/300 |

(Continued)

*Primary Examiner* — Stephen L Blau

(57) ABSTRACT

Examples of golf club grips and methods to manufacture golf club grips are generally described herein. In one example, a golf club may include a grip portion having at least one weight portion that is positioned outwardly from a shaft axis of the golf club shaft. Other examples and examples may be described and claimed.

18 Claims, 26 Drawing Sheets

(56) References Cited

U.S. PATENT DOCUMENTS

| | | | | |
|---|---|---|---|---|
| 6,902,492 | B1 * | 6/2005 | Strand | A63B 53/14 473/201 |
| 6,988,958 | B2 | 1/2006 | Roelke | |
| D516,653 | S * | 3/2006 | Gazeley | D21/756 |
| D524,372 | S * | 7/2006 | Granick | D19/204 |
| D531,243 | S * | 10/2006 | Davis | D21/756 |
| 7,635,310 | B2 * | 12/2009 | Keough | A63B 53/14 473/297 |
| 8,323,130 | B1 * | 12/2012 | LeVault | A63B 49/08 473/549 |
| 8,608,586 | B2 * | 12/2013 | Parente | A63B 53/007 473/292 |
| D756,473 | S * | 5/2016 | McIlroy | D21/756 |
| 9,387,379 | B1 * | 7/2016 | Sanyal | A63B 53/14 |
| 9,421,439 | B2 * | 8/2016 | McLoughlin | A63B 60/34 |
| 9,463,363 | B2 | 10/2016 | Dingman et al. | |
| 9,616,298 | B1 | 4/2017 | Barksdale et al. | |
| 9,700,772 | B2 * | 7/2017 | Goldfader | A63B 53/14 |
| 9,861,869 | B2 * | 1/2018 | Wilkowski | A63B 53/14 |
| D816,177 | S * | 4/2018 | Garsen | D21/756 |
| 10,046,213 | B2 * | 8/2018 | Goldfader | A63B 53/14 |
| 2003/0084756 | A1 * | 5/2003 | Schroder | B25G 1/01 81/20 |
| 2003/0207241 | A1 * | 11/2003 | Manual | A63B 53/14 434/252 |
| 2007/0219015 | A1 * | 9/2007 | Gazeley | A63B 53/007 473/300 |
| 2008/0009363 | A1 * | 1/2008 | Solodovnick | A63B 60/24 473/297 |
| 2014/0342845 | A1 | 11/2014 | Dingman | |
| 2018/0290033 | A1 * | 10/2018 | Rife | A63B 60/24 |
| 2018/0369669 | A1 * | 12/2018 | Rife | A63B 60/24 |

* cited by examiner

GOLF CLUB GRIPS AND METHODS TO MANUFACTURE GOLF CLUB GRIPS

CROSS REFERENCE

This application claims the benefit of U.S. Provisional Application No. 62/491,095, filed Apr. 27, 2017, the disclosure of which is incorporated by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club grips and methods to manufacturing golf club grips.

BACKGROUND

Golf clubs have grips by which an individual holds a golf club and swings the golf club during a stroke. The grip is typically manufactured from foam, cork or other low density material.

Figure 1:
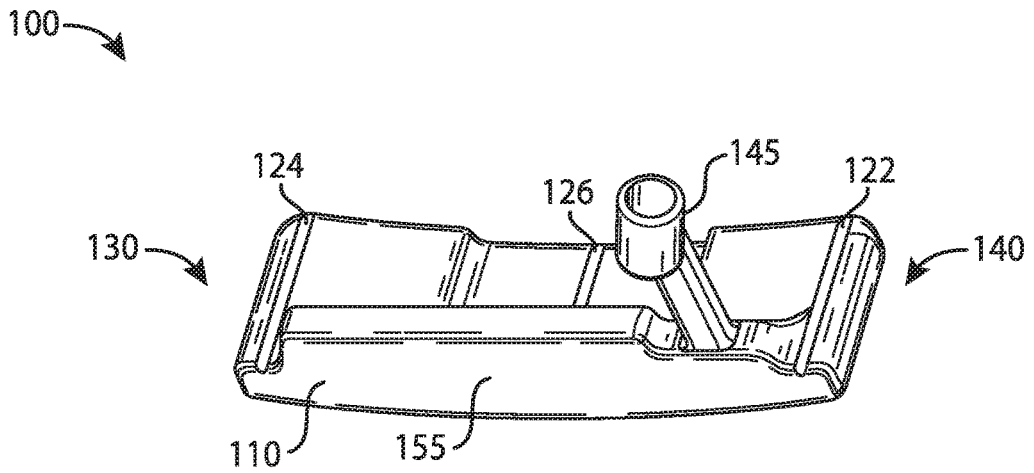
FIG. 1 depicts a front perspective view of a golf club head according to an example of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and grips and methods to manufacture golf club heads and grips are described herein. The apparatus, methods, and articles of manufacture described herein are not limited in this regard.

In the example of FIGS. 1-10, a golf club head 100 may include a body portion 110, and a visual guide portion 120, generally shown 122, 124, and 126. The body portion 110 may include a toe portion 130, a heel portion 140, a front portion 150, a rear portion 160, a top portion 170, and a sole portion 180. The body portion 110 may be manufactured via various manufacturing methods and/or processes (e.g., a casting process, a forging process, a milling process, a cutting process, a grinding process, a welding process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. Although FIGS. 1-10 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The toe and heel portions 130 and 140, respectively, may be on opposite ends of the body portion 110. The heel portion 140 may include a hosel portion 145 configured to receive a shaft (not shown) with a grip (not shown) on one end and the golf club head 100 on the opposite end of the shaft to form a golf club. Alternatively, the heel portion 140 may include a bore portion to receive the shaft (one shown as 1245 in FIGS. 11-13). The toe and heel portions 130 and 140, respectively, may define a width of the body portion 110.

In a similar manner, the front and rear portions 150 and 160, respectively, may be on opposite ends of the body portion 110. The front portion 150 may include a face portion 155 (e.g., a strike face). The face portion 155 may be used to impact a golf ball (one shown as 500 in FIG. 5). The face portion 155 may be an integral portion of the body portion 110. Alternatively, the face portion 155 may be a separate piece or an insert coupled to the body portion 110 via various manufacturing methods and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The front and rear portions 150 and 160, respectively, may define a length of the body portion 110 (shown as 920 in FIG. 9). The apparatus, methods, and articles of manufacture described herein are not limited in this regard.

In one example, the visual guide portion 120 may include a first guide portion 122, and a second guide portion 124. The first and second guide portions 122 and 124, respectively, may extend between the front and rear portions 150 and 160, respectively. For example, the first and second guide portions 122 and 124, respectively, may extend the length of the body portion 110. The first and second guide portions 122 and 124, respectively, may be substantially congruent (e.g., same length). Alternatively, the first and second guide portions 122 and 124, respectively, may have different lengths. That is, the first guide portion 122 may be longer than the second guide portion 124 or vice versa. The apparatus, methods, and articles of manufacture described herein are not limited in this regard.

The visual guide portion 120 may include a solid line portion, a dashed line portion, a dotted line portion, or any combination thereof. As shown in the figures, for example, the first and second guide portions 122 and 124, respectively, may be solid line portions. The visual guide portion 120 may include a colored line portion, a raised line portion, a recessed line portion, a laser-etched line portion, or any combination thereof. For example, the first and second guide portions 122 and 124, respectively, may be colored and recessed line portions (e.g., including a contrast layer relative to the body portion 110). The first and second guide portions 122 and 124, respectively, may be the same color, which may be different than the color of the body portion 110 (e.g., two contrasting colors). For example, the first and second guide portions 122 and 124, respectively, may be a white color whereas the body portion 110 may be a black color (e.g., a black-nickel chrome). Alternatively, the body portion 110 and/or the visual guide portions 120 may be manufactured with different methods and/or processes so that the body portion 110 and the visual guide portion 120 may have contrasting finishes. For example, the body portion 110 may have a black-nickel chrome finish whereas the first and second guide portions 122 and 124, respectively, may have a stainless-steel finish. While the above examples may describe the first and second guide portions 122 and 124, respectively, having the same color, the first and second guide portions 122 and 124, respectively, may have different colors. The apparatus, methods, and articles of manufacture described herein are not limited in this regard.

Figure 2:
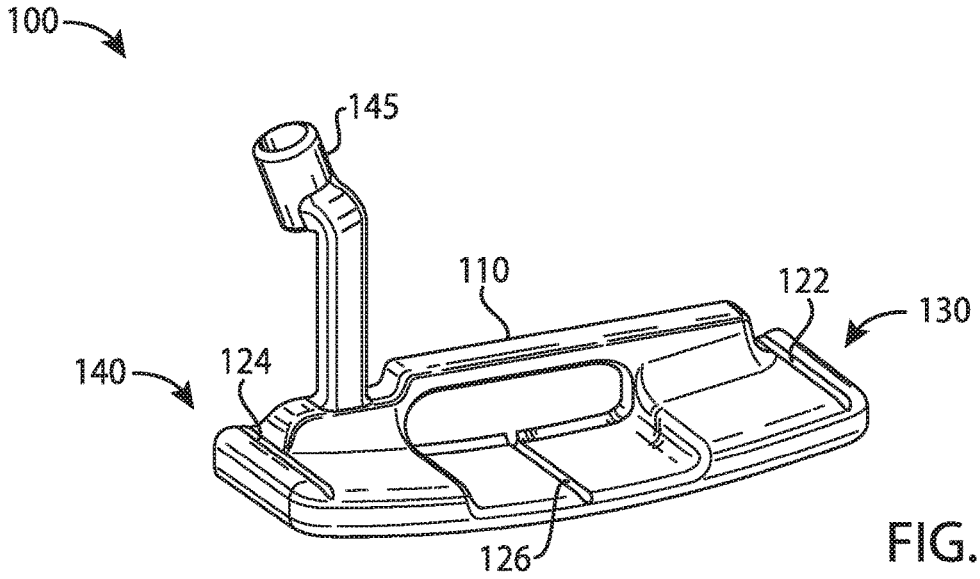
FIG. 2 depicts a rear perspective view of the example golf club head of FIG. 1.
Figure 3:
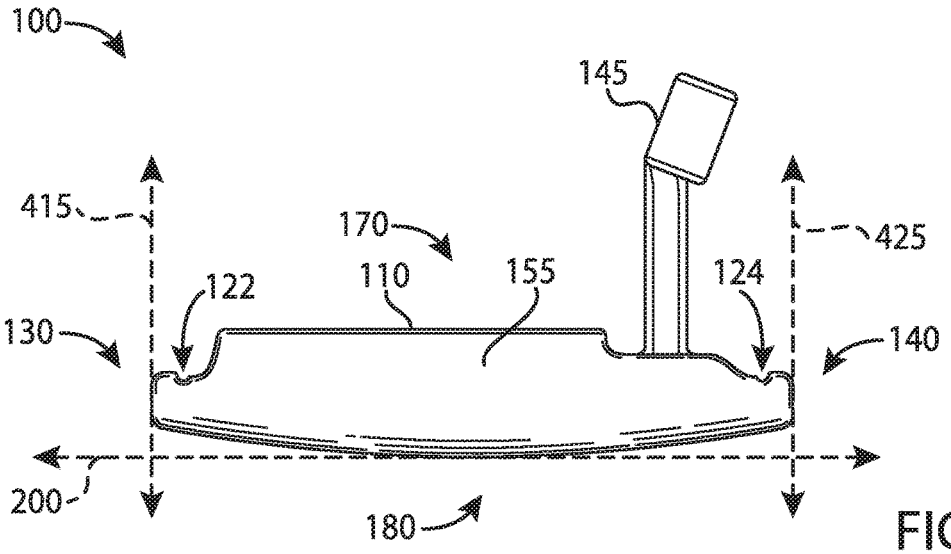
FIG. 3 depicts a front view of the example golf club head of FIG. 1.
Figure 4:
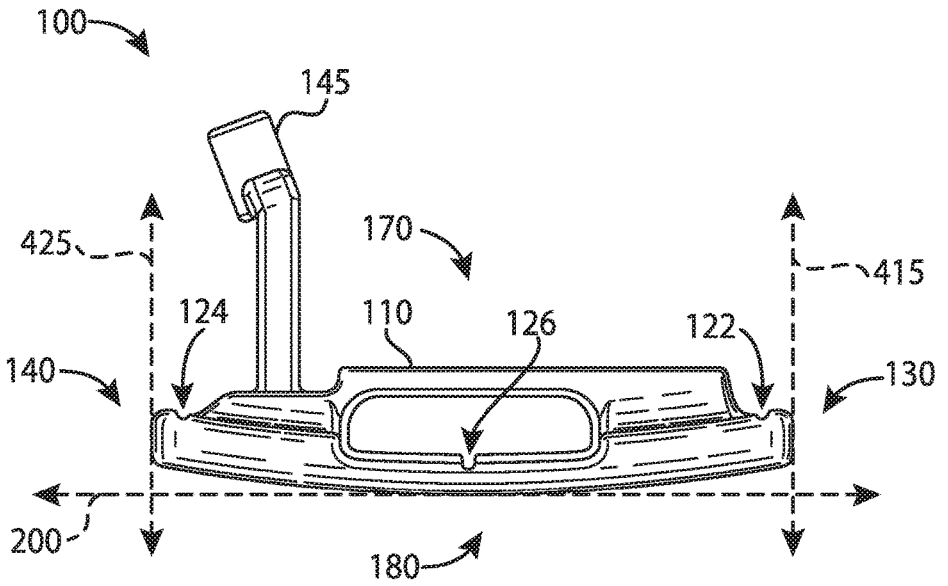
FIG. 4 depicts a rear view of the example golf club head of FIG. 1.

Further, the first and second guide portions 122 and 124, respectively, may be substantially parallel to each other. The first and second guide portions 122 and 124, respectively, may be separated by at least 1.68 inches. The first guide portion 122 may be located at or proximate to the toe portion 130 whereas the second guide portion 124 may be located at or proximate to the heel portion 140. For example, the first guide portion 122 may be located less than one inch from an outer edge of the toe portion 130 whereas the second guide portion 124 may be located less than one inch from an outer edge of the heel portion 140. In particular, the toe portion 130 may be associated with a toe end point 135, and the heel portion 140 may be associated with a heel end point 145. The toe end point 135 may be tangential to a first vertical plane 415 (FIG. 4), and the heel end point 145 may be tangential to a second vertical plane 425 (FIG. 4). The first and second vertical planes 415 and 425, respectively, may be substantially parallel to each other and substantially perpendicular to a ground plane 200 (FIGS. 2 and 3). In one example, the first guide portion 122 may be located on the toe portion 130 less than one inch from the first vertical plane 415, and the second guide portion 124 may be located on the heel portion 140 less than one inch from the second vertical plane 425. Alternatively, the first and second guide portions 122 and 124, respectively, may be located at different distances from the first and second vertical planes 415 and 425, respectively. For example, the first guide portion 122 may be located 0.5 inch (12.7 mm) from the first vertical plane 415 whereas the second guide portion 124 may be located at 0.75 inch from the second vertical plane 425. The apparatus, methods, and articles of manufacture described herein are not limited in this regard.

Figure 9:
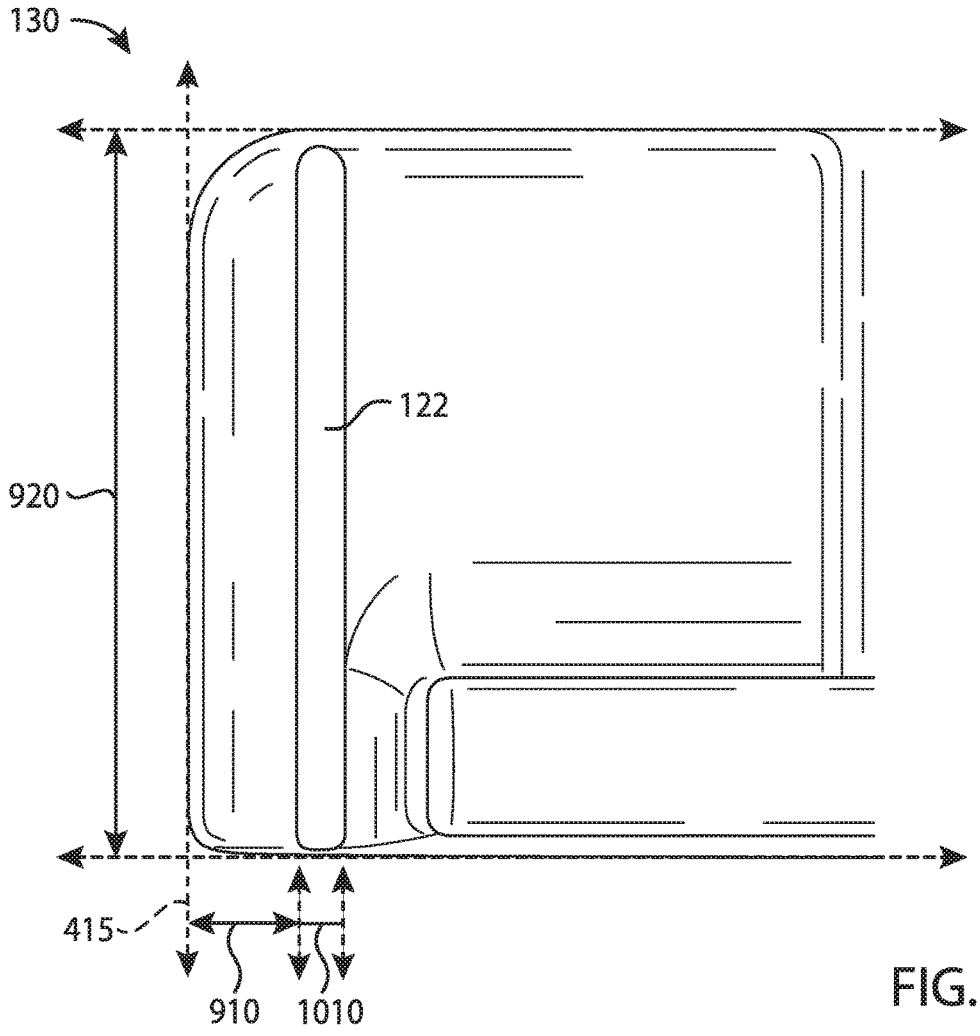
FIG. 9 depicts an exploded view of an example toe portion of the example golf club head of FIG. 1.
Figure 10:
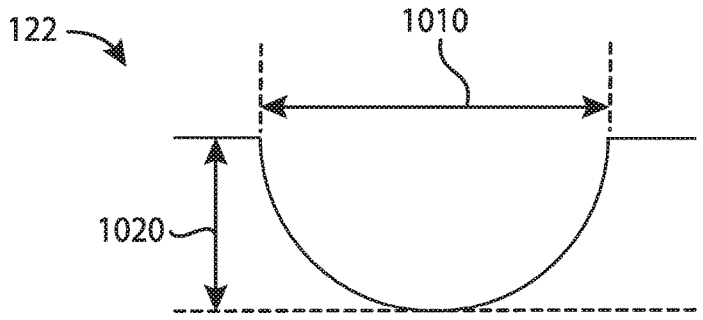
FIG. 10 depicts an exploded view of an example visual guide portion of the example golf club head of FIG. 1.

As mentioned above, the first and second guide portions 122 and 124, respectively, may be recessed line portions. For example, the first and second guide portions 122 and 124, respectively, may have a U-like cross-section shape. Alternatively, the first and second guide portions 122 and 124, respectively, may have a V-like cross-section shape or any other suitable cross-section shape. Turning to FIGS. 9 and 10, for example, the first guide portion 122 may be located a distance 910 from the first vertical plane 415. The distance 910 may be less than one inch. The first guide portion 122 may have a length 920 of at least 0.5 inch (12.7 mm). In particular, the length 920 may be about 1.6 inch. Further, the first guide portion 122 may have a width 1010 of at least 0.05 inch, and a depth 1020 of at least 0.015 inch. In one example, the width 1010 may be about 0.1 inch, and the depth 1020 may be about 0.05 inch. The apparatus, methods, and articles of manufacture described herein are not limited in this regard.

Figure 5:
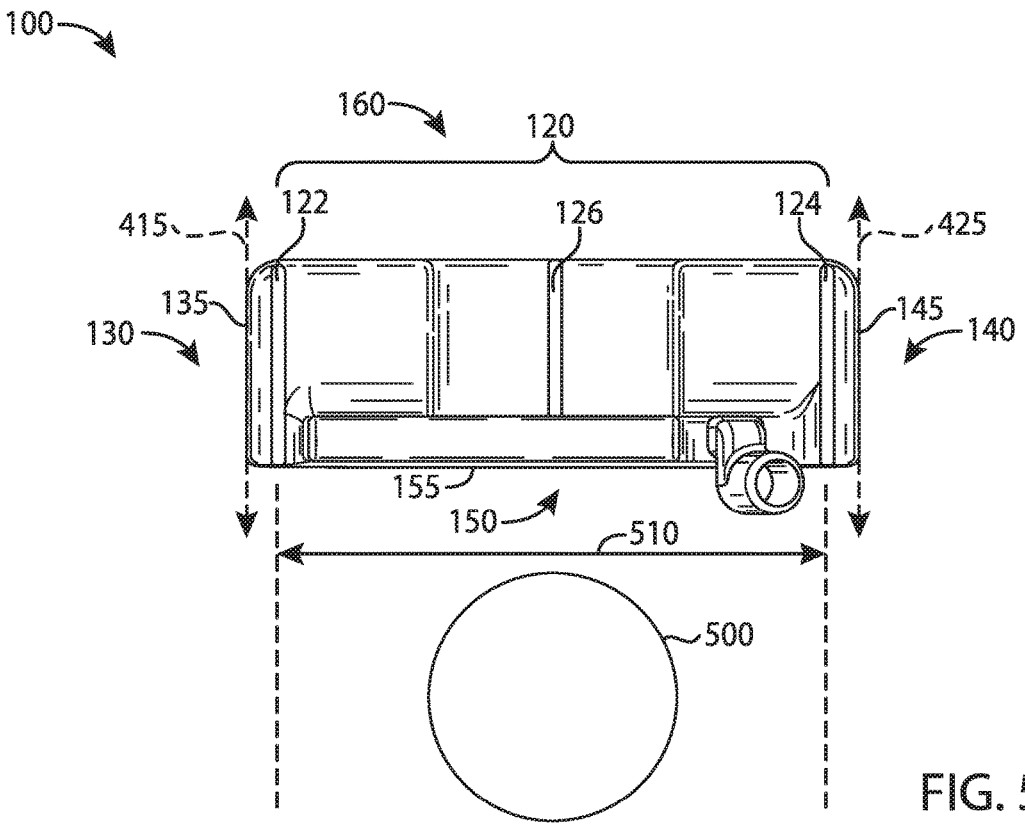
FIG. 5 depicts a top view of the example golf club head of FIG. 1.
Figure 6:
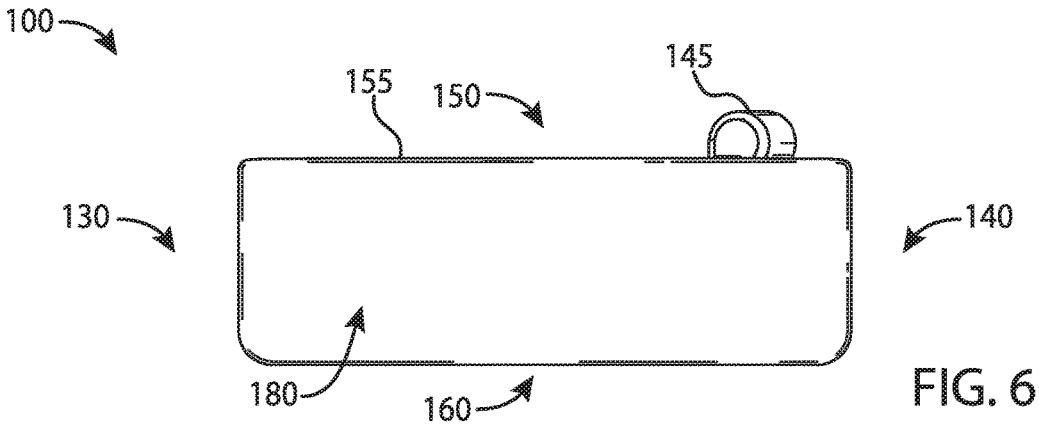
FIG. 6 depicts a bottom view of the example golf club head of FIG. 1.
Figure 7:
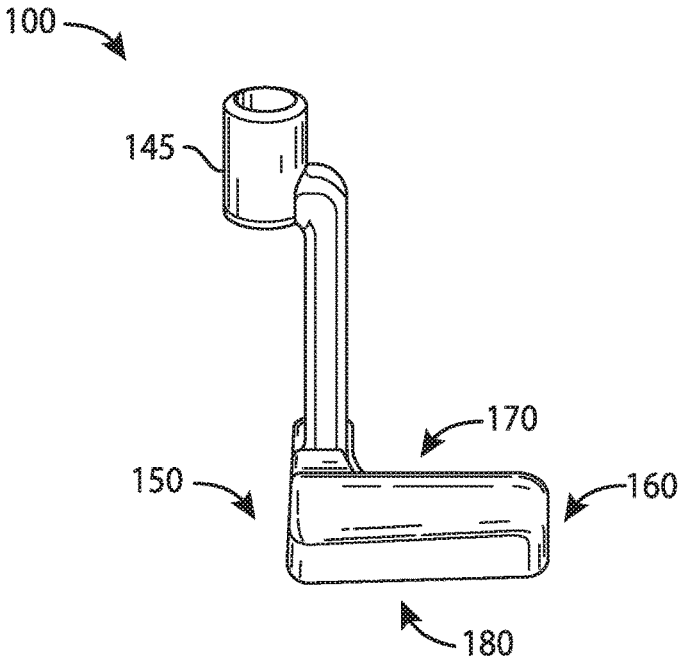
FIG. 7 depicts a left view of the example golf club head of FIG. 1.
Figure 8:
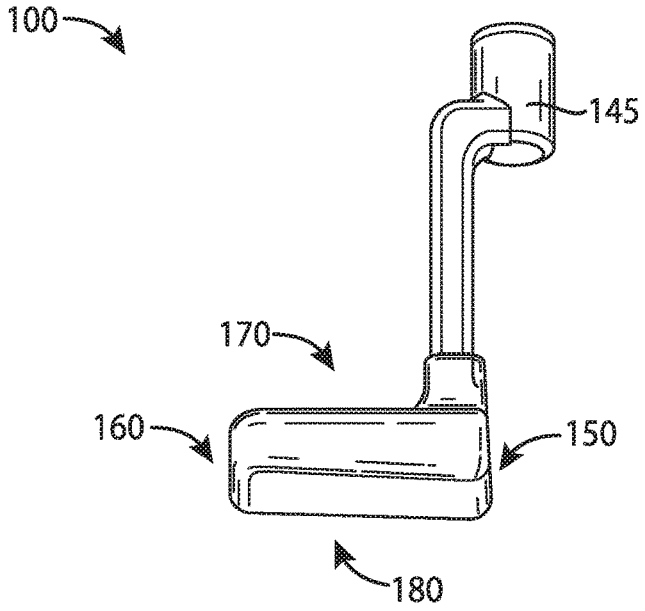
FIG. 8 depicts a right view of the example golf club head of FIG. 1.
Figure 11:
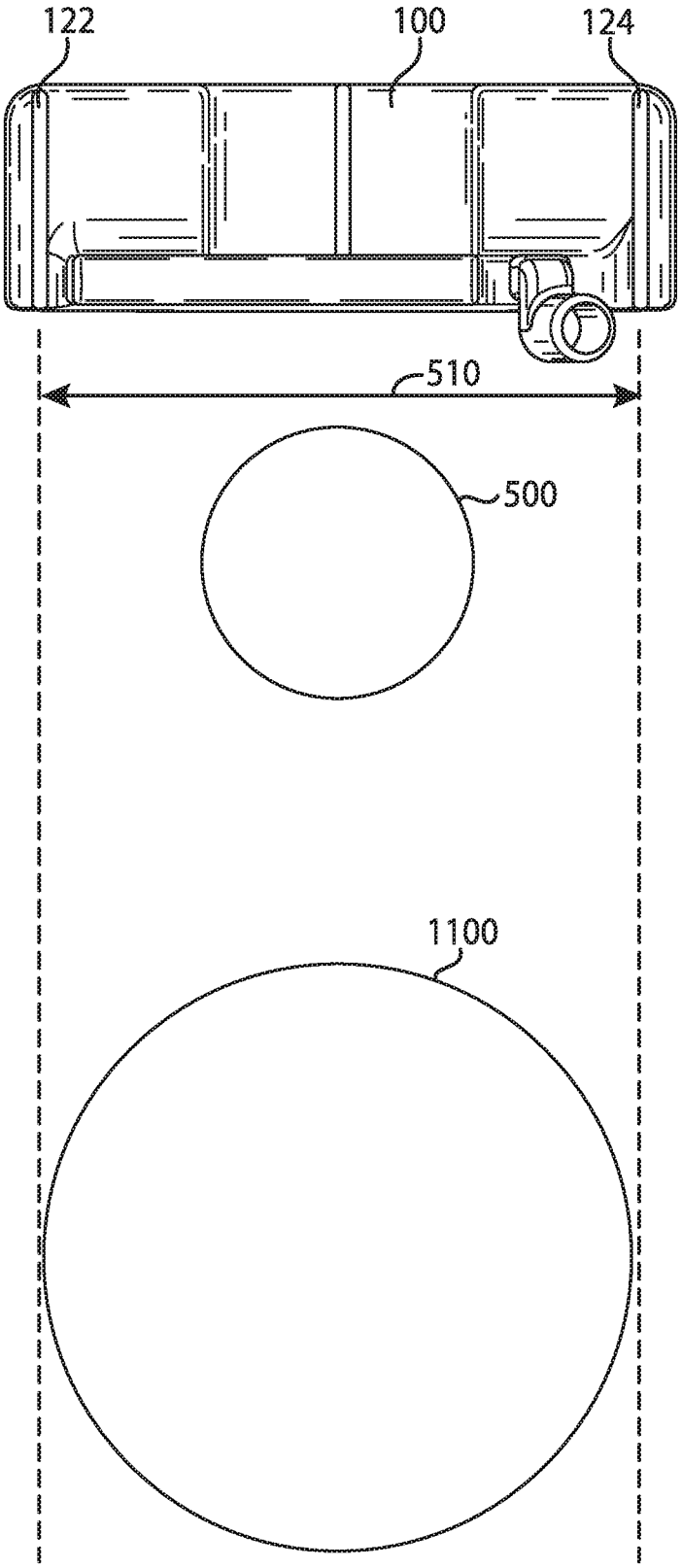
FIG. 11 depicts an example golf hole relative to the example golf club head of FIG. 1.

As with other alignment aids, the visual guide portion 120 may help with visual alignment. In contrast to other alignment aids, however, the visual guide portion 120 may help an individual to visualize a golf ball relative to a golf hole or cup. As illustrated in FIGS. 5 and 11, for example, a distance 510 may separate the first and second guide portions 122 and 124, respectively. In particular, the distance 510 may be greater than a diameter of a golf ball 500 (e.g., 1.68 inches or 42.67 millimeters). For example, the distance 510 may be greater than a diameter of a golf cup 1100 (e.g., 4.25 inches or 107.95 millimeters). By providing a mental image of the golf ball 500 being relatively smaller than the golf cup 1100 (i.e., the golf ball 500 may be less than 40% of the golf cup 1100), the first and second guide portions 122 and 124, respectively, may help build an individual's confidence and ability to putt. Alternatively, the distance 510 may be less than or equal to 4.25 inches but greater than 1.68 inches to provide a mental image of the golf ball 500 being relatively smaller than the golf cup 1100. The apparatus, methods, and articles of manufacture described herein are not limited in this regard.

The visual guide portion 120 may also include a third guide portion 126. The third guide portion 126 may bisect the body portion 110. In one example, the third guide portion 126 may be substantially equidistant from the first and second guide portions 122 and 124, respectively. The third guide portion 126 may be the same as or different from the first and/or second guide portions 122 and 124, respectively. In one example, the first, second, and third guide portions 122, 124, and 126, respectively, may be recessed line portions with the same color. Alternatively, the first and second guide portions 122 and 124, respectively, may be recessed guide portions whereas the third guide portion 126 may be a raised line portion. In another example, the third guide portion 126 may be a different color than the first and second guide portions 122 and 124, respectively. In yet another example, the third guide portion 126 may have a different length than the first and second guide portions 122 and 124. The apparatus, methods, and articles of manufacture described herein are not limited in this regard.

Figure 12:
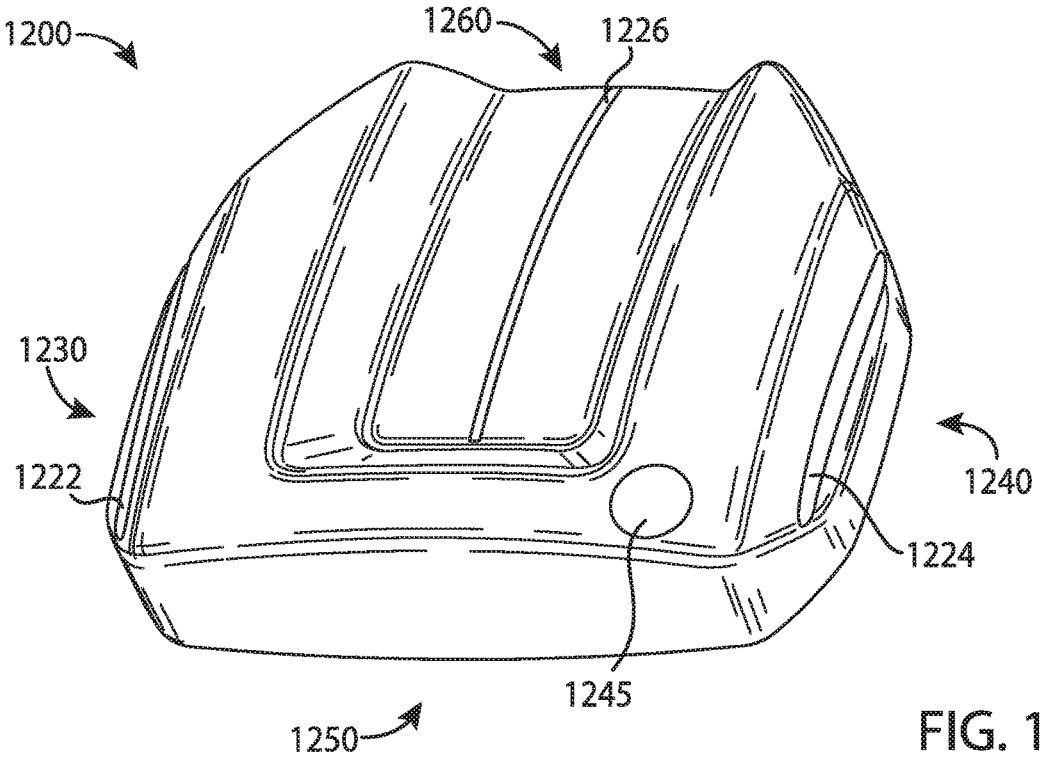
FIG. 12 depicts a front perspective view of a golf club head according to another example of the apparatus, methods, and articles of manufacture described herein.
Figure 13:
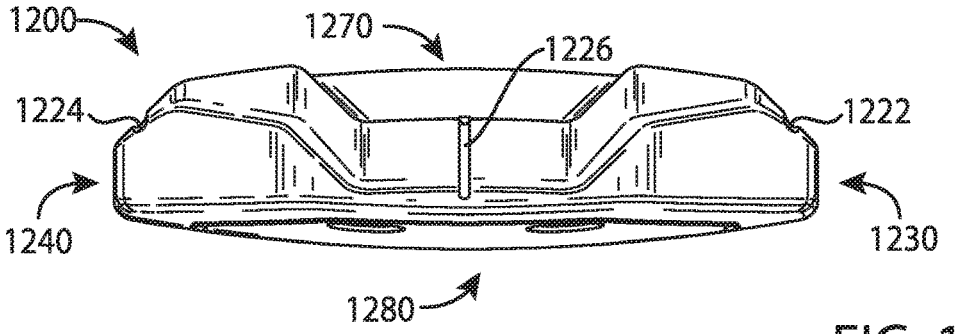
FIG. 13 depicts a rear perspective view of the example golf club head of FIG. 11.
Figure 14:
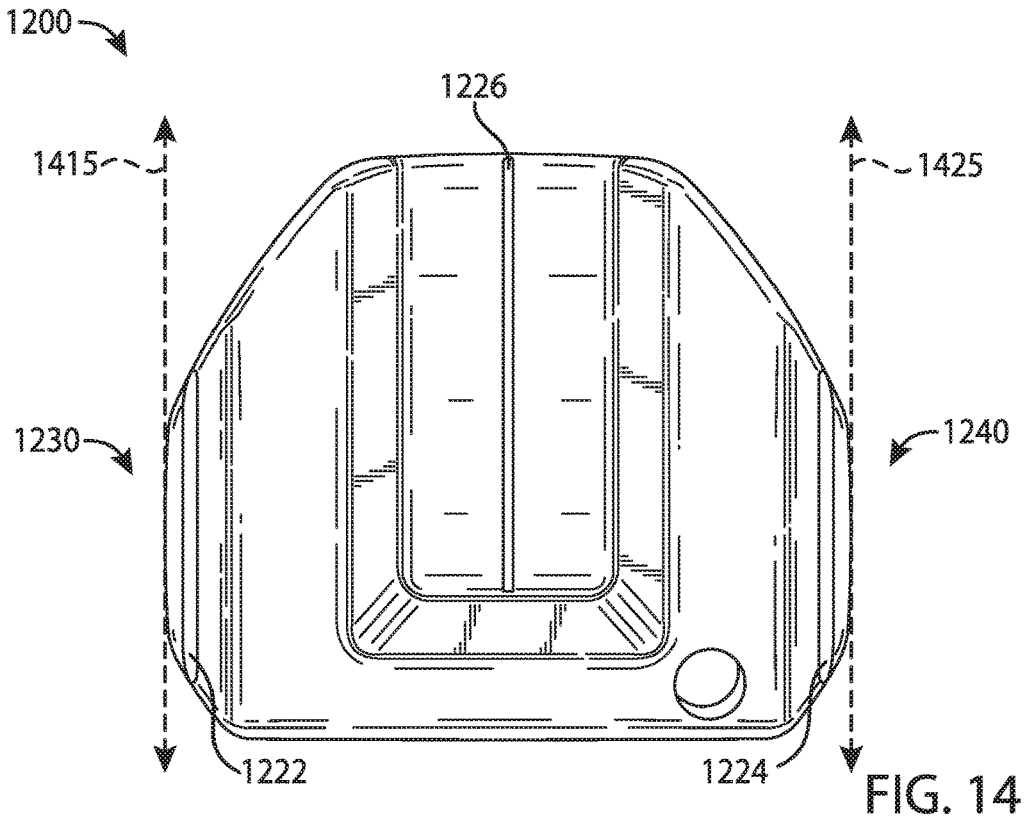
FIG. 14 depicts a top view of the example golf club head of FIG. 11.

Referring to FIGS. 12-14, for example, a golf club head 1200 may include a body portion 1210, and a visual guide portion 1220, generally shown 1222, 1224, and 1226. The body portion 1210 may include a toe portion 1230, a heel portion 1240, a front portion 1250, a rear portion 1260, a top portion 1270, and a sole portion 1280. Instead of a hosel, the golf club head 1200 may include a bore 1245 to receive a shaft (not shown). In a similar manner to the visual guide portions 122 and 124 (FIGS. 1-11), the visual guide portions 1222 and 1224 may be located a particular distance from a first vertical plane 1415 and a second vertical plane 1425, respectively. For example, the visual guide portion 1222 may be located less than one inch from the first vertical plane 1415 and the visual guide portion 1224 may be located less than one inch from the second vertical plane 1425. Further, a distance may be separate the visual guide portions 1222 and 1224, which may be greater than a diameter of a golf ball. The apparatus, methods, and articles of manufacture described herein are not limited in this regard.

Figure 15:
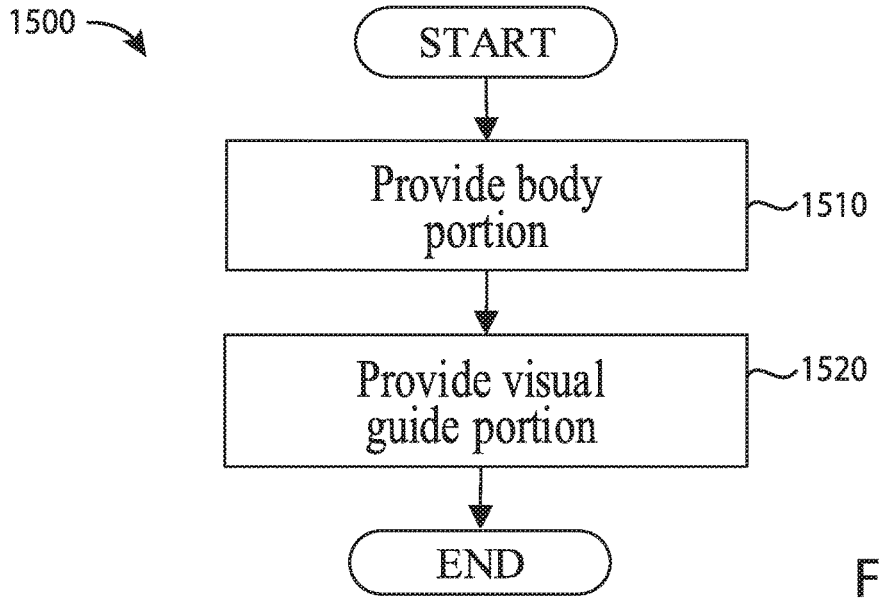
FIG. 15 depicts one manner in which the example golf club heads described herein may be manufactured.
Figure 16:
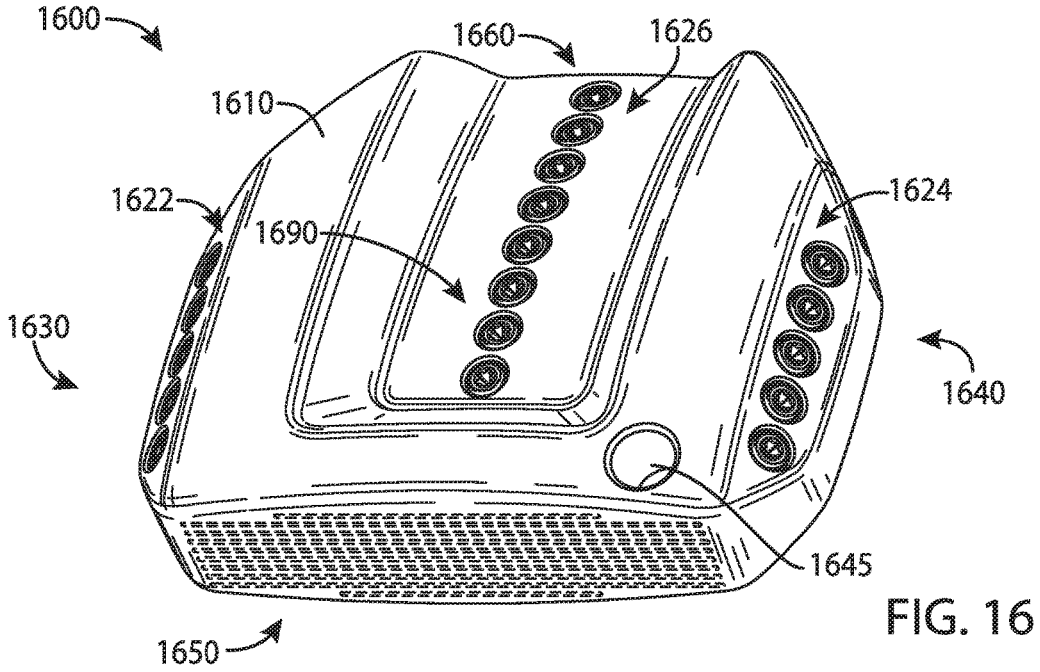
FIG. 16 depicts a front perspective view of a golf club head according to yet another example of the apparatus, methods, and articles of manufacture described herein.
Figure 17:
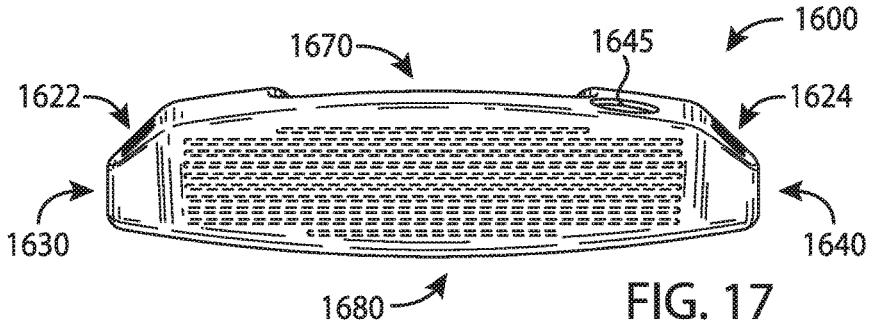
FIG. 17 depicts a front view of the example golf club head of FIG. 16.
Figure 18:
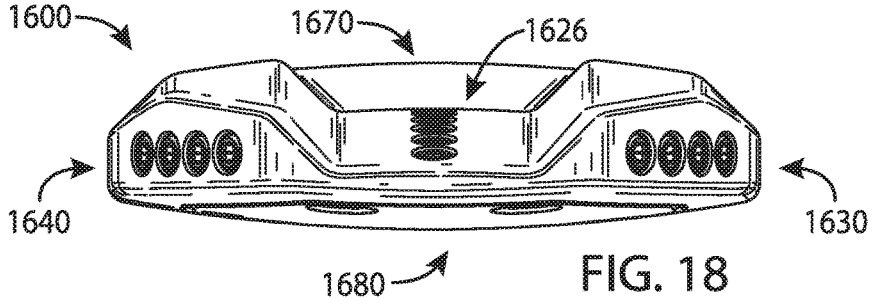
FIG. 18 depicts a rear view of the example golf club head of FIG. 16.
Figure 19:
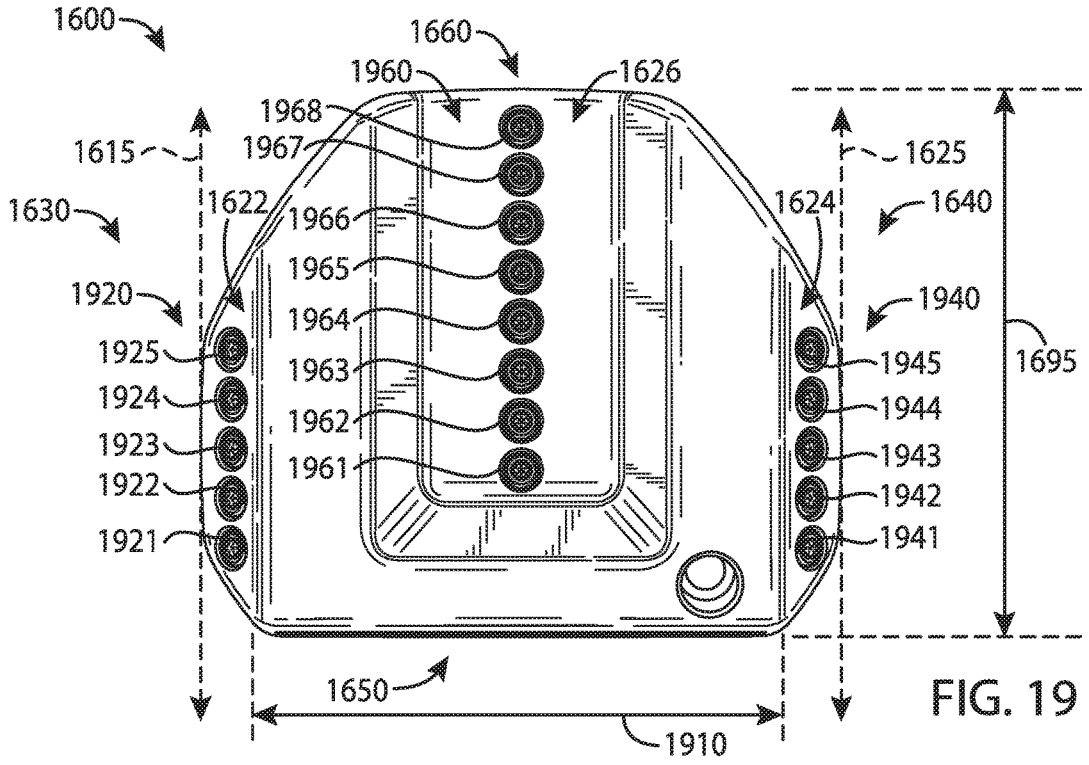
FIG. 19 depicts a top view of the example golf club head of FIG. 16.
Figure 20:
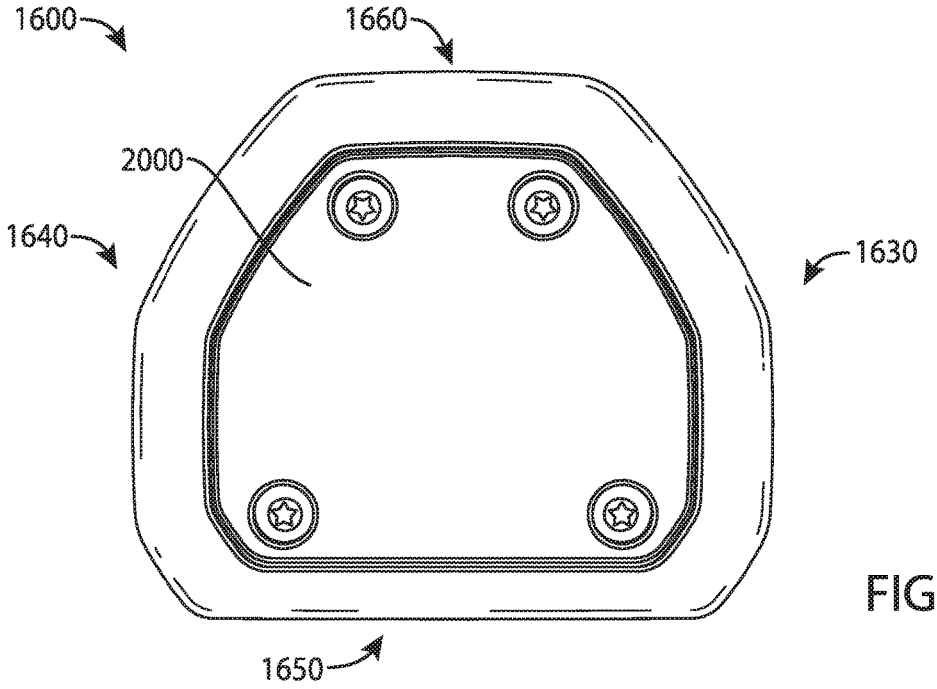
FIG. 20 depicts a bottom view of the example golf club head of FIG. 16.
Figure 21:
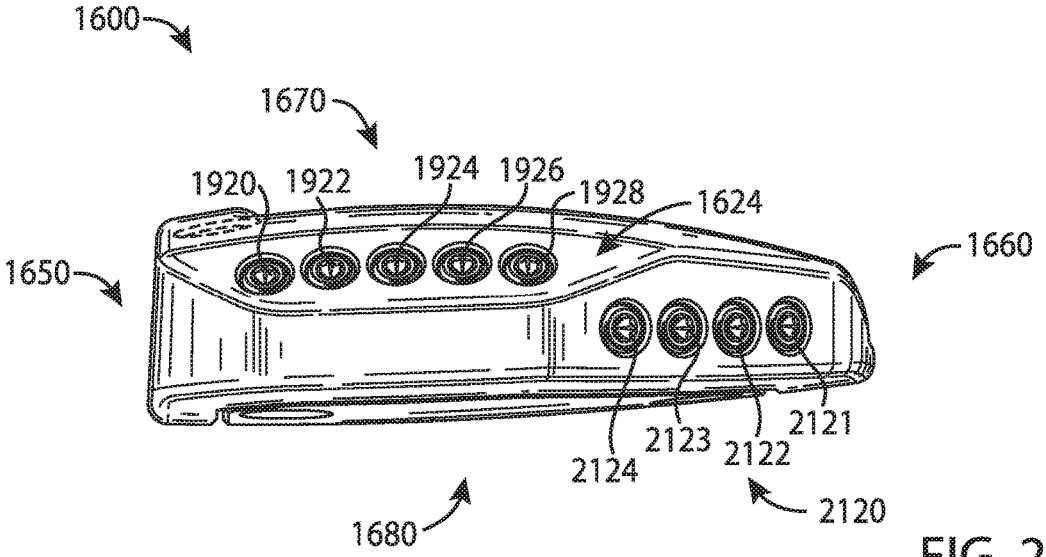
FIG. 21 depicts a left view of the example golf club head of FIG. 16.
Figure 22:
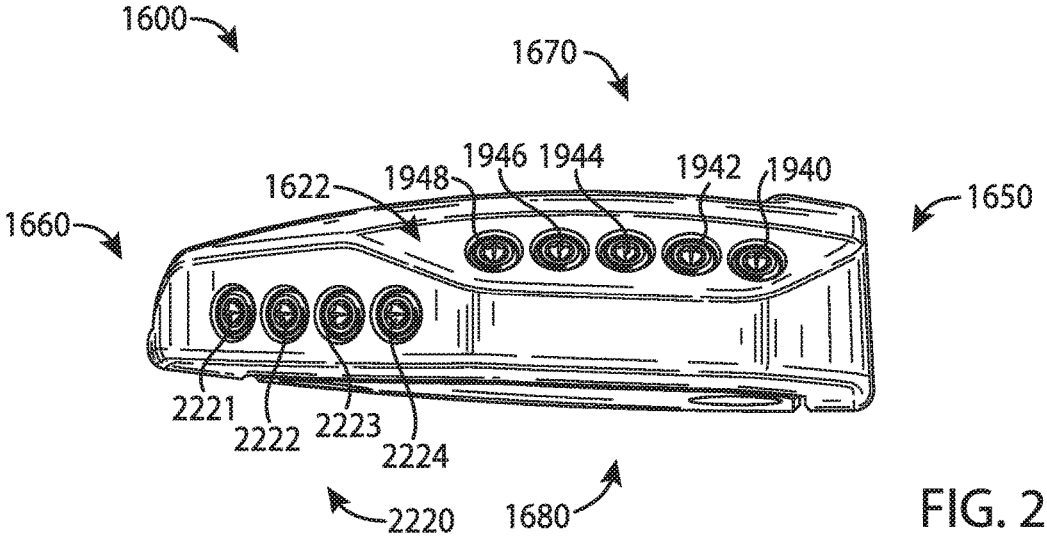
FIG. 22 depicts a right view of the example golf club head of FIG. 16.

FIG. 15 depicts one manner in which the example golf club head described herein may be manufactured. In the example of FIG. 15, the process 1500 may begin with providing a body portion 110 having a toe portion 130, a heel portion 140, a front portion 150, and a rear portion 160 (block 1510). The front portion 150 may include a strike face 155 to strike a golf ball. The body portion 110 may be manufactured via various manufacturing methods and/or processes (e.g., a casting process, a forging process, a milling process, etc.).

To provide a visual guide to strike the golf ball with the strike face, the process 1500 may provide a visual guide portion 120 extending between the front and rear portions 150 and 160 (block 1520). The visual guide portion 120 may include a first guide portion 122 located at or proximate to the toe portion 130, and a second guide portion 124 located at or proximate to the heel portion 140. The first and second guide portions 122 and 124, respectively, may be substantially parallel to each other. The visual guide portion 120 may be manufactured via various manufacturing methods and/or processes (e.g., a casting process, a forging process, a milling process, etc.). For example, the visual guide portion 120 may be manufactured with the same manufacturing process as the body portion 110 (e.g., a casting process or a milling process). In another example, the visual guide portion 120 may be manufactured with a milling process whereas the body portion 110 may be manufactured with a casting process. The apparatus, methods, and articles of manufacture described herein are not limited in this regard.

Referring back to FIG. 15, the example process 1500 is merely provided and described in conjunction with other figures as an example of one way to manufacture the golf club head 100. While a particular order of actions is illustrated in FIG. 15, these actions may be performed in other temporal sequences. For example, two or more actions depicted in FIG. 15 may be performed sequentially, concurrently, or simultaneously. In one example, blocks 1510 and 1520 may be performed simultaneously or concurrently. Although FIG. 15 depicts a particular number of blocks, the process may not perform one or more blocks. The apparatus, methods, and articles of manufacture described herein are not limited in this regard.

Turning to FIGS. 16-28, for example, a golf club head 1600 may include a body portion 1610 (e.g., FIGS. 23 and 24), and a visual guide portion 1620, generally shown as 1622, 1624, and 1626. The body portion 1610 may include a toe portion 1630, a heel portion 1640, a front portion 1650, a rear portion 1660, a top portion 1670, and a sole portion 1680. The body portion 1610 may also include a bore 1645 to receive a shaft (not shown). Alternatively, the body portion 1610 may include a hosel (not shown) to receive a shaft. The body portion 1610 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.). The apparatus, methods, and articles of manufacture described herein are not limited in this regard.

Figure 23:
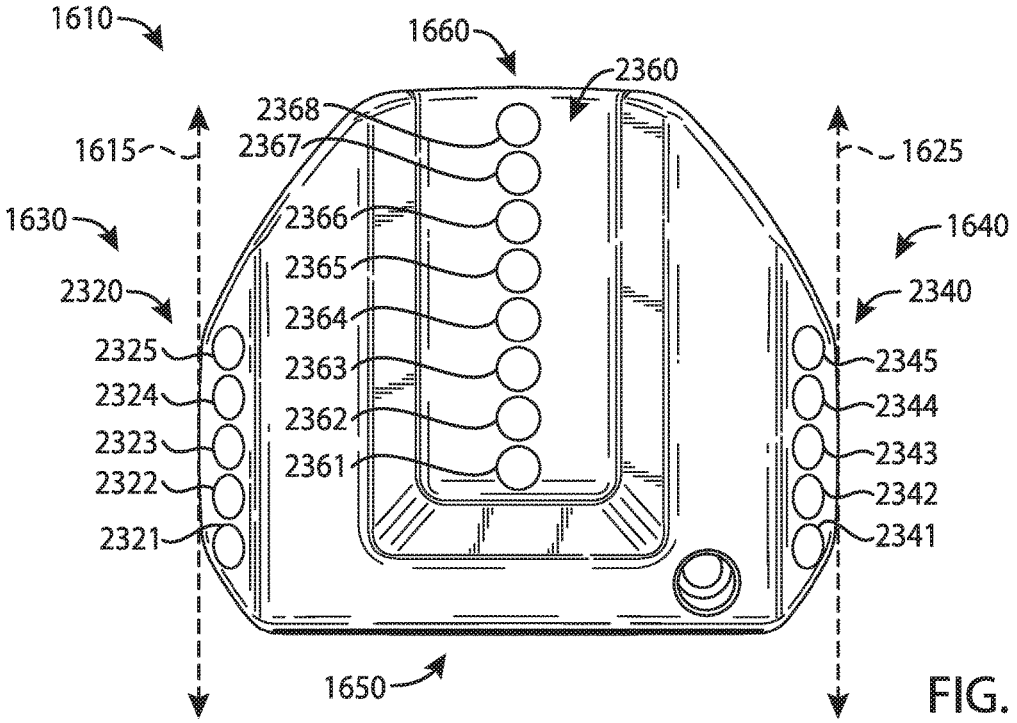
FIG. 23 depicts a top view of a body portion of the example golf club head of FIG. 16.

As illustrated in FIG. 23, for example, the body portion 1610 may include two or more weight ports, generally shown as a first set of weight ports 2320 (e.g., shown as weight ports 2321, 2322, 2323, 2324, and 2325) to form the first visual guide portion 1622 and a second set of weight ports 2340 (e.g., shown as weight ports 2341, 2342, 2343, 2344, and 2345) to form the second visual guide portion 1624. The first and second sets of weight ports 2320 and 2340, respectively, may be exterior weight ports configured to receive one or more weight portions (e.g., one shown as 2500 in FIG. 25). In particular, the first and second sets of weight ports 2320 and 2340 may be located at or proximate to a periphery of the golf club head 1600. For example, the first and second sets of weight ports 2320 and 2340, respectively, may be on or proximate to the top portion 1670. The first set of weight ports 2320 may be at or proximate to the toe portion 1630 whereas the second set of weight ports 2340 may be at or proximate to the heel portion 1640.

Each weight port of the first set of weight ports 2320 may have a first port diameter ($PD_1$). In particular, a uniform distance of less than the first port diameter may separate any two adjacent weight ports of the first set 2320 (e.g., (i) weight ports 2321 and 2322, (ii) weight ports 2322 and 2323, (iii) weight ports 2323 and 2324, or (iv) weight ports 2324 and 2325). In one example, the first port diameter may be about 0.25 inch and any two adjacent weight ports of the first set 2320 may be separated by 0.1 inch. In a similar manner, each weight port of the second set of weight ports 2340 may have a second diameter ($PD_2$). A uniform distance of less than the second port diameter may separate any two adjacent weight ports of the second set 2340 (e.g., (i) weight ports 2341 and 2342, (ii) weight ports 2342 and 2343, (iii) weight ports 2343 and 2344, or (iv) weight ports 2344 and 2345). The first and second port diameters may be equal to each other (i.e., $PD_1=PD_2$). For example, a the second port diameter may be about 0.25 inch and any two adjacent weight ports of the second set 2340 may be separated by 0.1 inch. The apparatus, methods, and articles of manufacture described herein are not limited in this regard.

As noted above, the visual guide portion 1620 may include a third guide portion 1626. Accordingly, the body portion 1610 may include two or more weight ports, generally shown as a third set of weight ports 2360 (e.g., shown as weight ports 2361, 2362, 2363, 2364, 2365, 2366, 2367, and 2368) to form the third guide portion 1626. In particular, the third guide portion 1626 may be substantially equidistant from the first and second guide portions 1622 and 1624. For example, the third guide portion 1626 may extend between the front and rear portions 1650 and 1660 located at or proximate to a center of the body portion 1610. Each weight port of the third set of weight ports 2360 may have a third port diameter ($PD_3$). The third port diameter may be equal to the first port diameter or the second port diameter (e.g., $PD_1=PD_2=PD_3$). In particular, a uniform distance of less than the third port diameter may separate any two adjacent weight ports of the third set 2360 (e.g., (i) weight ports 2361 and 2362, (ii) weight ports 2362 and 2363, (iii) weight ports 2363 and 2364, (iv) weight ports 2364 and 2365, (v) weight ports 2365 and 2366, (vi) weight ports 2366 and 2367, or (vii) weight ports 2367 and 2368). The body portion 1610 may also include a U-shape recess portion 1690. The third guide portion 1626 may be located in the U-shape recess portion 1690. The apparatus, methods, and articles of manufacture described herein are not limited in this regard.

Figure 24:
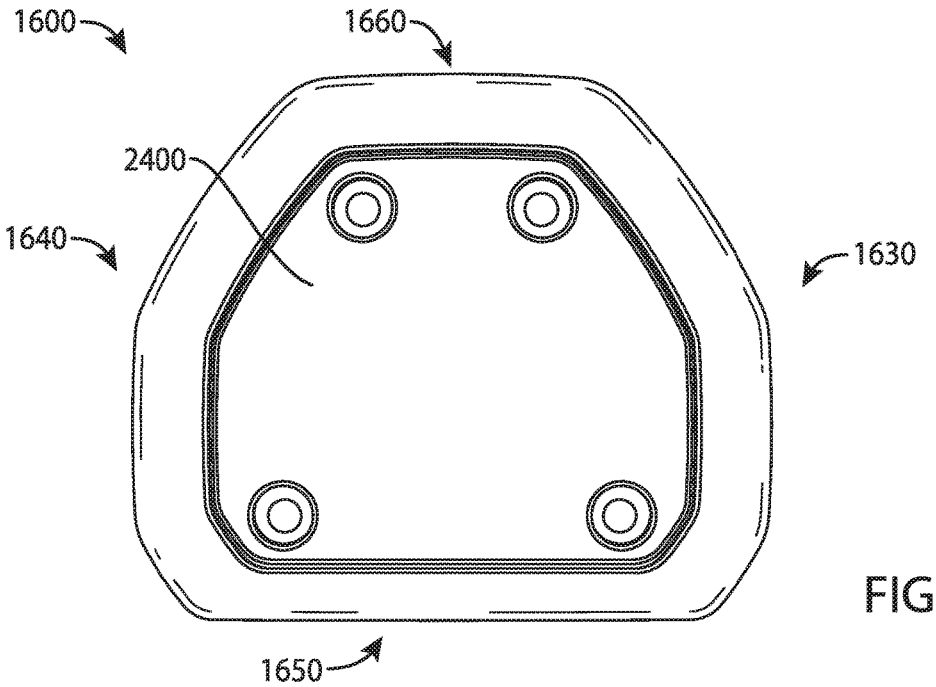
FIG. 24 depicts a bottom view of the example body portion of FIG. 23.

Further as shown in FIG. 24, the body portion 1610 may include an interior cavity 2400. The interior cavity 2400 may be partially or entirely filled with an elastic polymer or elastomer material, a thermoplastic elastomer material (TPE), a thermoplastic polyurethane material (TPU), and/or other suitable types of materials to absorb shock, isolate vibration, and/or dampen noise. A plate portion 2000 (FIG. 20) may cover the interior cavity 2400 from the sole portion 1680. The plate portion 2000 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.) with one shown as 2810 in FIG. 28.

In a similar manner to the visual guide portions 1222 and 1224 (FIGS. 12-14), the visual guide portions 1622 and 1624, respectively, may be located a particular distance from a first vertical plane 1615 and a second vertical plane 1625, respectively. For example, the visual guide portion 1622 may be located less than one inch from the first vertical plane 1615 and the visual guide portion 1624 may be located less than one inch from the second vertical plane 1625.

Further, a distance 1910 may separate the visual guide portions 1622 and 1624, which may be greater than a diameter of a golf ball. In one example, the distance 1910 may be greater than three inches (3 in.). In another example, the distance 1910 may be about 3.75 inches.

The visual guide portions 1622 and 1624 may be located relative to the periphery of the golf club head 1600. In one example, the visual guide portion 1622 may be located less than 0.5 inch (12.7 mm) from the periphery at or proximate to the toe portion 1630 whereas the visual guide portion 1624 may be located less than 0.5 inch (12.7 mm) from the periphery at or proximate to the heel portion 1640. Further, each of the visual guide portions 1622 and 1624 may extend about a maximum length 1690 between the front and rear portions 1650 and 1660. Alternatively, each of the visual guide portions 1622 and 1624 may extend less than 50% of the maximum length 1690 between the front and rear portions 1650 and 1660. The apparatus, methods, and articles of manufacture described herein are not limited in this regard.

Instead of a solid line (e.g., the visual guide portions 1222 and 1224), each of the visual guide portions 1622 and 1624, respectively, may be dotted lines formed by two or more weight portions, generally shown as a first set of weight portions 1920 (e.g., shown as 1921, 1922, 1923, 1924, and 1925) and a second set of weight portions 1940 (e.g., shown as 1941, 1942, 1943, 1944, and 1945). In a similar manner, the visual guide portion 1626 may be a dotted line formed by two or more weight portions, generally shown as the third set of weight portions 1960 (e.g., shown as 1961, 1962, 1963, 1964, 1965, 1966, 1967, and 1968). The first, second, and third sets of weight portions 1920, 1940, and 1960, respectively, may be partially or entirely made of a high-density material such as a tungsten-based material or suitable types of materials. Alternatively, the first, second, and third sets of weight portions 1920, 1940, and 1960, respectively, may be partially or entirely made of a non-metal material (e.g., composite, plastic, etc.). The apparatus, methods, and articles of manufacture described herein are not limited in this regard.

Figure 25:
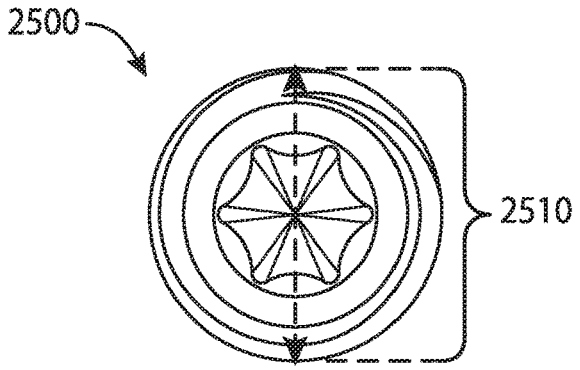
FIG. 25 depicts a top view of a weight portion associated with the example golf club head of FIG. 16.
Figure 26:
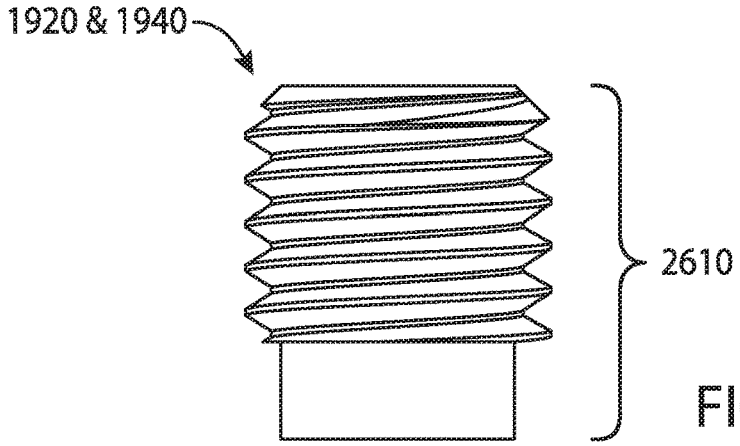
FIG. 26 depicts a side view of a weight portion associated with the example golf club head of FIG. 16.
Figure 27:
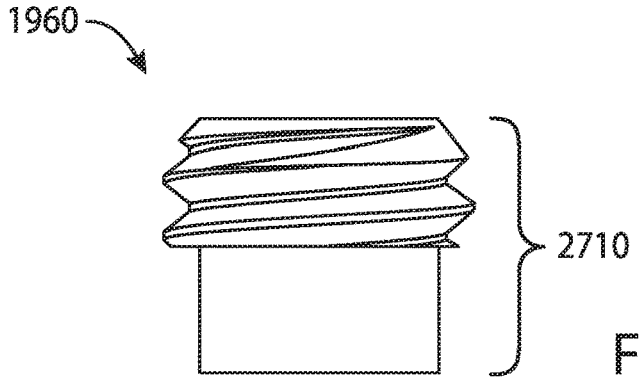
FIG. 27 depicts a side view of another weight portion associated with the example golf club head of FIG. 16.
Figure 28:
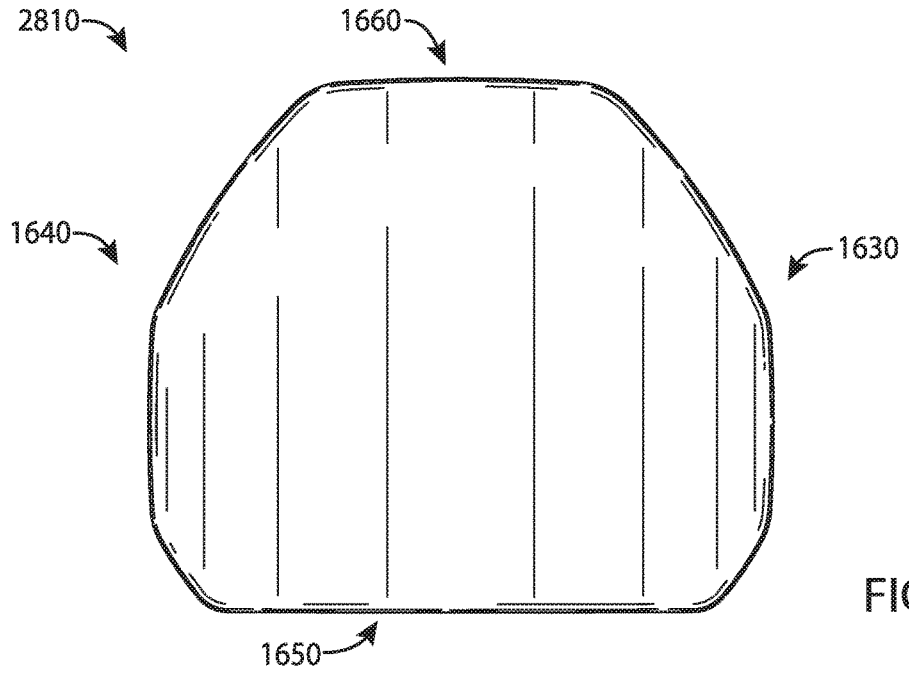
FIG. 28 depicts a bottom view of another example body portion of FIG. 16.

The first, second, and third sets of weight portions 1920, 1940, and 1960, respectively, may have similar or different physical properties (e.g., density, shape, mass, volume, size, color, etc.). In the illustrated example as shown in FIGS. 25-27, each of the weight portions of the first, second, and third sets 1920, 1940, and 1960 may have a cylindrical shape (e.g., a circular cross section). Alternatively, each of the weight portions of the first and second sets 1920 and 1940 may have a first shape (e.g., a cylindrical shape) whereas each of the weight portions of the third set 1960 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

Further, each of the weight portions of the first, second, and third sets 1920, 1940, and 1960, respectively, may have a diameter 2510 of about 0.25 inch but the first, second, and third sets of weight portions 1920, 1940, and 1960, respectively, may be different in height. In particular, each of the weight portions of the first and second sets 1920 and 1940 may be associated with a first height 2610 (FIG. 26), and each of the weight portion of the third set 1960 may be associated with a second height 2710 (FIG. 27). The first height 2610 may be relatively longer than the second height 2710. In one example, the first height 2610 may be about 0.3 inch whereas the second height 2710 may be about 0.16 inch. Alternatively, the first height 2610 may be equal to or less than the second height 2710. The apparatus, methods, and articles of manufacture described herein are not limited in this regard.

The first and second sets of weight portions 1920 and 1940, respectively, may include threads to secure in the weight ports. For example, each weight portion of the first and second sets of weight portions 1920 and 1940 may be a screw. The first and second sets of weight portions 1920 and 1940, respectively, may not be readily removable from the body portion 1610 with or without a tool. Alternatively, the first and second sets of weight portions 1920 and 1940, respectively, may be readily removable (e.g., with a tool) so that a relatively heavier or lighter weight portion may replace one or more of the weight portions of the first and second sets 1920 and 1940, respectively. In another example, the first and second sets of weight portions 1920 and 1940, respectively, may be secured in the weight ports of the body portion 1610 with epoxy or adhesive so that the first and second sets of weight portions 1920 and 1940, respectively, may not be readily removable. In yet another example, the first and second sets of weight portions 1920 and 1940, respectively, may be secured in the weight ports of the body portion 1610 with both epoxy and threads so that the first and second sets of weight portions 1920 and 1940, respectively, may not be readily removable. The apparatus, methods, and articles of manufacture described herein are not limited in this regard.

The golf club head 1600 may also include a fourth set of weight portions 2120 (e.g., shown as 2121, 2122, 2123, and 2124) and a fifth set of weight portions 2220 (e.g., shown as 2221, 2222, 2223, and 2224). Although both the fourth and fifth sets of weight portions 2120 and 2220 may be located at or proximate to the rear portion 1660, the fourth set of weight portions 2120 may be located at or proximate to the heel portion 1640 whereas the fifth set of weight portions 2220 may be at or proximate to the toe portion 1630. Each of the fourth and fifth sets of weight portions 2120 and 2220 may include at least three weight portions. The apparatus, methods, and articles of manufacture described herein are not limited in this regard.

Figure 29:
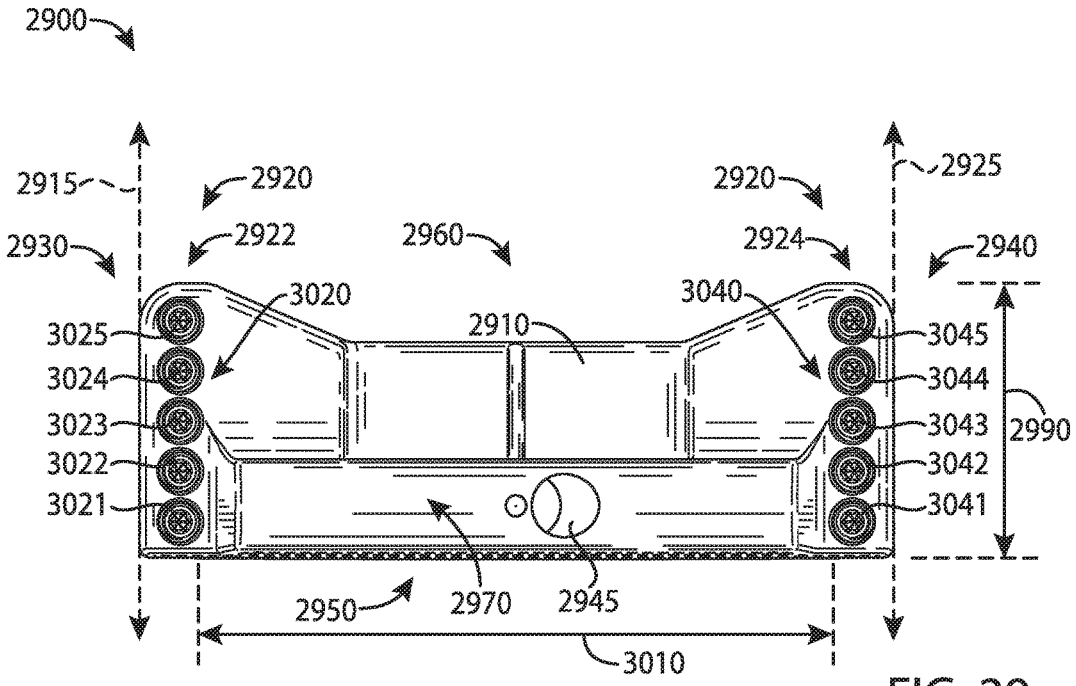
FIG. 29 depicts a top view of a golf club head according to yet another example of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While FIGS. 16-24 may depict a particular type of putter club head (e.g., a mallet-type putter club head), the apparatus, methods, and articles of manufacture described herein may be applicable to other types of putters. As illustrated in FIG. 29, the apparatus, methods, and articles of manufacture described herein may be applicable to a blade-type putter club head 2900. For example, the golf club head 2900 may include a body portion 2910, and a visual guide portion 2920, generally shown as 2922, and 2924. The body portion 2910 may include a toe portion 2930, a heel portion 2940, a front portion 2950, a rear portion 2960, and a top portion 2970. The body portion 2910 may also include a bore 2945 to receive a shaft (not shown). Alternatively, the body portion 2910 may include a hosel (not shown) to receive a shaft. The body portion 2910 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 2910 may be partially or entirely made of a non-metal material (e.g., composite, plastic, etc.). The apparatus, methods, and articles of manufacture described herein are not limited in this regard.

In a similar manner to the visual guide portions 1622 and 1624 (FIGS. 16-24), the visual guide portions 2922 and 2924, respectively, may be located a particular distance from a first vertical plane 2915 and a second vertical plane 2925, respectively. For example, the visual guide portion 2922 may be located less than one inch from the first vertical plane 2915 and the visual guide portion 2924 may be located less than one inch from the second vertical plane 2925. Further, a distance 3010 may separate the visual guide portions 2922 and 2924, which may be greater than a diameter of a golf ball. In one example, the distance 3010 may be greater than three inches (3 in.). In another example, the distance 3010 may be about 3.75 inches.

The visual guide portions 2922 and 2924 may be located relative to the periphery of the golf club head 2900. In one example, the visual guide portion 2922 may be located less than 0.5 inch (12.7 mm) from the periphery at or proximate to the toe portion 2930 whereas the visual guide portion 2924 may be located less than 0.5 inch (12.7 mm) from the periphery at or proximate to the heel portion 2940. Further, each of the visual guide portions 2922 and 2924 may extend about a maximum length 2990 between the front and rear portions 2950 and 2960. Alternatively, each of the visual guide portions 2922 and 2924 may extend less than 50% of the maximum length 2990 between the front and rear portions 2950 and 2960. The apparatus, methods, and articles of manufacture described herein are not limited in this regard.

Each of the visual guide portions 2922 and 2924, respectively, may be dotted lines formed by two or more weight portions, generally shown as a first set of weight portions 3020 (e.g., shown as 3021, 3022, 3023, 3024, and 3025) and a second set of weight portions 3040 (e.g., shown as 3041, 3042, 3043, 3044, and 3045). The first and second sets of weight portions 3020 and 3040, respectively, may be partially or entirely made of a high-density material such as a tungsten-based material or suitable types of materials. Alternatively, the first and second sets of weight portions 3020 and 3040, respectively, may be partially or entirely made of a non-metal material (e.g., composite, plastic, etc.). The apparatus, methods, and articles of manufacture described herein are not limited in this regard.

The first and second sets of weight portions 3020 and 3040, respectively, may have similar or different physical properties (e.g., density, shape, mass, volume, size, color, etc.). In the illustrated example as shown in FIGS. 25-27, each of the weight portions of the first and second sets 3020 and 3040 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The first and second sets of weight portions 3020 and 3040, respectively, may include threads to secure in the weight ports, which may also have corresponding threads. For example, each weight portion of the first and second sets of weight portions 3020 and 3040 may be a screw. The first and second sets of weight portions 3020 and 3040, respectively, may not be readily removable from the body portion 2910 with or without a tool. Alternatively, the first and second sets of weight portions 3020 and 3040, respectively, may be readily removable (e.g., with a tool) so that a relatively heavier or lighter weight portion may replace one or more of the weight portions of the first and second sets 3020 and 3040, respectively. In another example, the first and second sets of weight portions 3020 and 3040, respectively, may be secured in the weight ports of the body portion 2010 with epoxy or adhesive so that the first and second sets of weight portions 3020 and 3040, respectively, may not be readily removable. In yet another example, the first and second sets of weight portions 3020 and 3040, respectively, may be secured in the weight ports of the body portion 2910 with both epoxy and threads so that the first and second sets of weight portions 3020 and 3040, respectively, may not be readily removable. The apparatus, methods, and articles of manufacture described herein are not limited in this regard.

Figure 30:
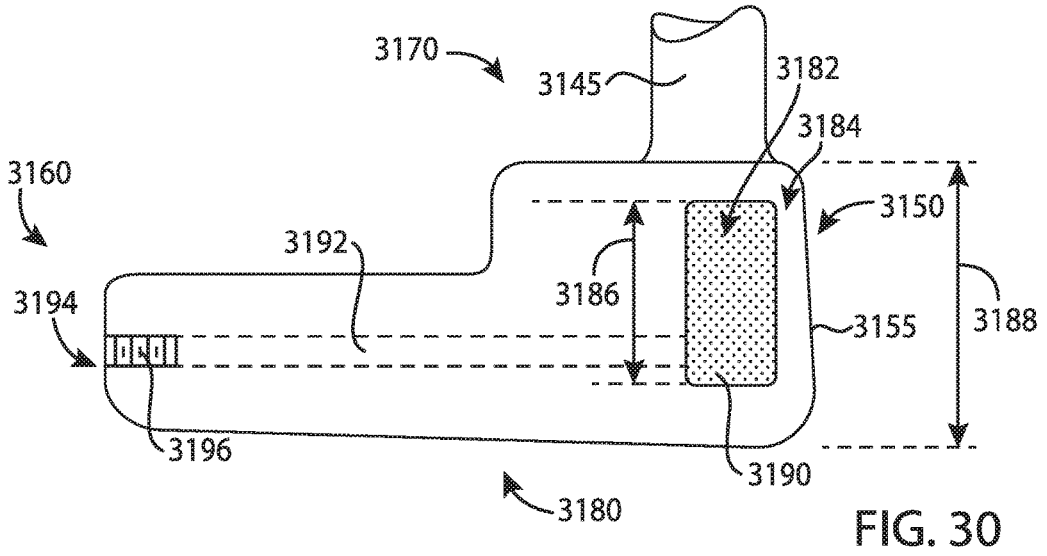
FIG. 30 depicts a cross-sectional view of a golf club head according to yet another example of the apparatus, methods and articles of manufacture described herein.
Figure 31:
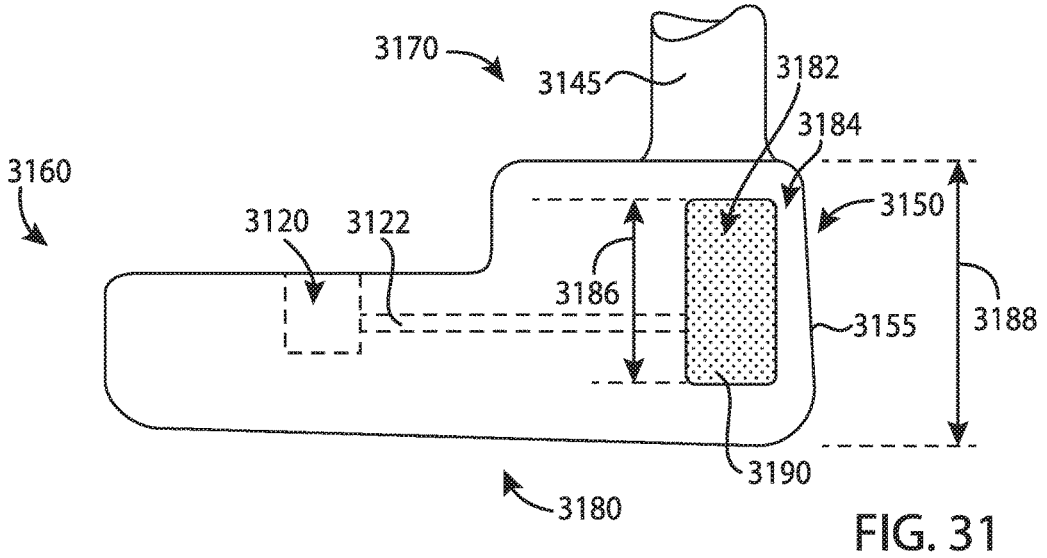
FIG. 31 depicts a cross-sectional view of another example of the golf club head of FIG. 30.
Figure 32:
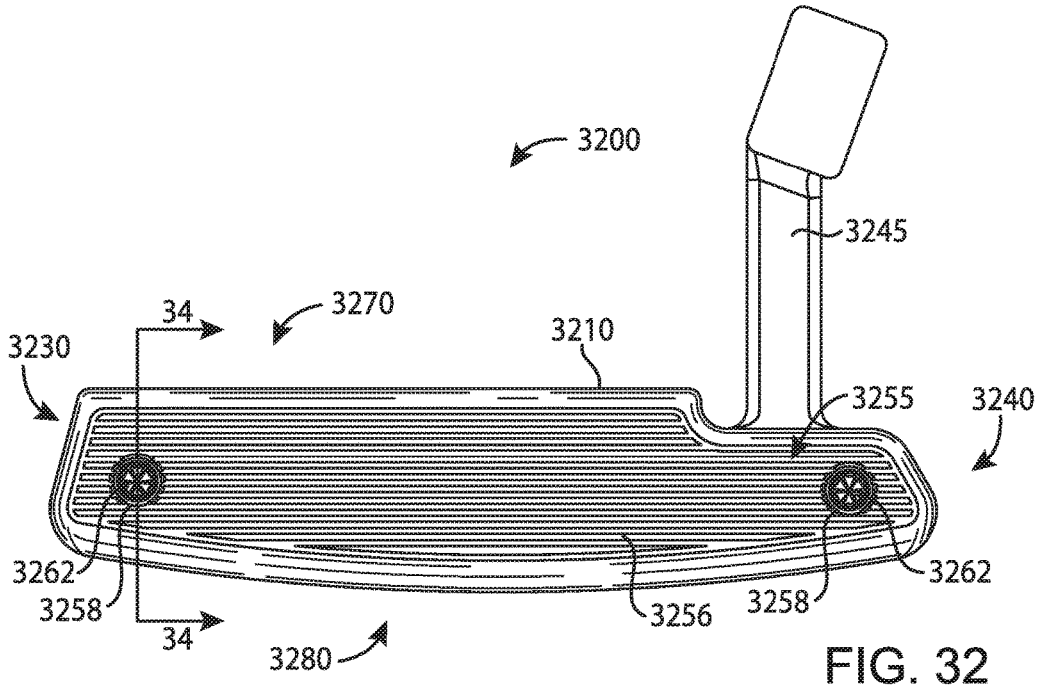
FIG. 32 depicts a front view of a golf club head according to yet another example of the apparatus, methods, and articles of manufacture described herein.
Figure 33:
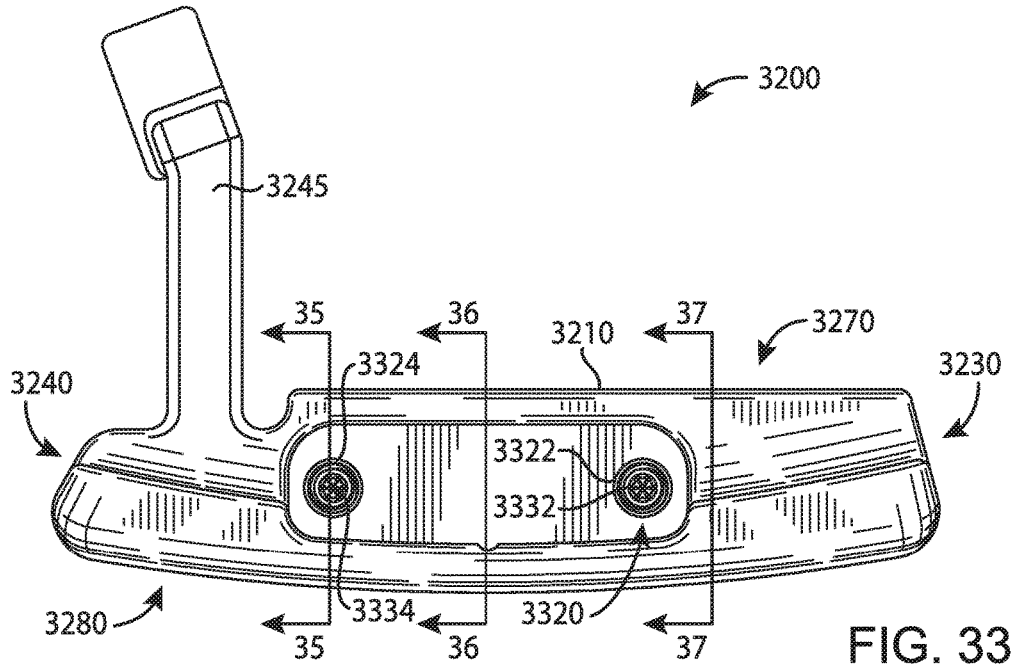
FIG. 33 depicts a rear view of the golf club head of FIG. 32.

In the example of FIGS. 30 and 31, a golf club head 3100 may include a body portion 3110. The body portion 3110 may include a toe portion (not shown), a heel portion (not shown), a front portion 3150, a rear portion 3160, a top portion 3170, and a sole portion 3180. The body portion 3110 may be manufactured via various manufacturing methods and/or processes (e.g., a casting process, a forging process, a milling process, a cutting process, a grinding process, a welding process, a combination thereof, etc.). The body portion 3110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 3110 may be partially or entirely made of non-metal material (e.g., composite, plastic, etc.). The golf club head 3100 may be a putter-type golf club head (e.g., a blade-type putter, a mid-mallet-type putter, a mallet-type putter, etc.). Based on the type of putter as mentioned above, the body portion 3110 may be at least 200 grams. For example, the body portion 110 may be in a range between 300 to 600 grams. Although FIGS. 30 and 31 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The body portion 3110 may include a hosel portion 3145 configured to receive a shaft (not shown) with a grip (not shown) on one end and the golf club head 3100 on the opposite end of the shaft to form a golf club. The front and rear portions 3150 and 3160, respectively, may be on opposite ends of the body portion 3110. The front portion 3150 may include a face portion 3155 (e.g., a strike face). The face portion 3155 may be used to impact a golf ball (one shown as 500 in FIG. 5). The face portion 3155 may be an integral portion of the body portion 3110. Alternatively, the face portion 3155 may be a separate piece or an insert coupled to the body portion 3110 via various manufacturing methods and/or processes (e.g., a bonding process, a welding process, a brazing process, a mechanical locking method, a mechanical fastening method, any combination thereof, or other suitable types of manufacturing methods and/or processes). The face portion 3155 may be associated with a loft plane that defines the loft angle of the golf club head 3100. The apparatus, methods, and articles of manufacture described herein are not limited in this regard.

The body portion 3110 may include one or more weight ports and one or more weight portions similar to any of the golf club heads described herein. For example, a weight port 3120 is shown in FIG. 31. For example, the body portion 3110 may include a first set of weight ports (not shown) similar to the weight ports 2320 of the golf club head 1600 and a second set of weight ports (not shown) similar to the weight ports 2340 of the golf club head 1600 that are configured to receive a plurality of weight portions. Accordingly, a detailed description of the weight ports and weight portions of the golf club head 3100 is not described. Alternatively, the body portion 3110 may not include any weight ports and/or weight portions.

The body portion 3110 may be a hollow body including an interior cavity 3182 extending between the front portion 3150 and the rear portion 3160. Further, the interior cavity 3182 may extend between the top portion 3170 and the sole portion 3180. A cavity wall portion 3184 may separate the interior cavity 3182 and the face portion 3155. The interior cavity 3182 may be associated with a cavity height 3186 ($H_C$), and the body portion 3110 may be associated with a body height 3188 ($H_B$). While the cavity height 3186 and the body height 3188 may vary between the toe and heel portions, the cavity height 3186 may be at least 50% of a body height 3188 ($H_C$>0.5*$H_B$). For example, the cavity height 3186 may vary between 70% and 85% of the body height 3188. With the cavity height 3186 of the interior cavity 3182 being greater than 50% of the body height 3188, the golf club head 3100 may produce relatively more consistent feel, sound, and/or result when the golf club head 3100 strikes a golf ball via the face portion 3155 than a golf club head with a cavity height of less than 50% of the body height. However, the cavity height 3186 may be less than 50% of the body height 3188. The apparatus, methods, and articles of manufacture described herein are not limited in this regard.

In one example, the interior cavity 3182 may be unfilled (i.e., empty space). Alternatively, the interior cavity 3182 may be partially or entirely filled with a filler material (e.g., generally shown as 3190). The filler material 3190 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3182 may be filled with a TPE material to absorb shock, isolate vibration, and/or dampen noise when the golf club head 3100 strikes a golf ball via the face portion 3155. The apparatus, methods, and articles of manufacture described herein are not limited in this regard.

In another example, the filler material 3190 may be a polymer material such as an ethylene copolymer material to absorb shock, isolate vibration, and/or dampen noise when the golf club head 3100 strikes a golf ball via the face portion 3155. In particular, at least 50% of the interior cavity 3182 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 3190 may be injected into the interior cavity 3182 by an injection molding process via a port 3192 on the body portion 3110 as shown in FIG. 30. The port 3192 may have an opening 3194 on the body portion 3110 to allow injection of the filler material into the interior cavity 3182 through the port 3192. The port 3192 may have a plug 3196, by which the opening 3194 may be closed after injection of the filler material 3190 into the interior cavity 3182. Alternatively, as shown in the example of FIG. 31, at least one of the weight ports 3120 on the body portion 3110 may be connected to the interior cavity 3182 through a connection port 3122 that may be similar to the port 3192. Accordingly, the filer material may be injected into the interior cavity 3182 from the at least one weight port 3120 through the connection port 3122.

For example, at least 50% of the interior cavity 3182 may be filled with a TPE material to absorb shock, isolate vibration, dampen noise, and/or provide structural support when the golf club head 3100 strikes a golf ball via the face portion 3155. With the support of the cavity wall portion 3184 and filling at least a portion of the interior cavity 3182 with an elastic polymer material, the face portion 3155 may be relatively thin without degrading the structural integrity, sound, and/or feel of the golf club head 3100. In one example, the face portion 3155 may have a thickness of less than or equal to 0.075 inch (e.g., the thickness of the cavity wall portion 3184). In another example, the face portion 3155 may have a thickness of less than or equal to 0.060 inch. In yet another example, the face portion 3155 may have a thickness of less than or equal to 0.050 inch. Further, the face portion 3155 may have a thickness of less than or equal to 0.030 inch. The apparatus, methods, and articles of manufacture described herein are not limited in this regard. The apparatus, methods, and articles of manufacture described herein may be implemented in a variety of examples, and the foregoing description of some of these examples does not necessarily represent a complete description of all possible examples. Instead, the description of the drawings, and the drawings themselves, disclose at least one example, and may disclosure alternative examples.

In the example of FIG. 31, a golf club head 3200 may include a body portion 3210. The body portion 3210 may include a toe portion 3230, a heel portion 3240, a front portion 3250, a rear portion 3260, a top portion 3270, and a sole portion 3280. The body portion 3210 may be manufactured via various manufacturing methods and/or processes (e.g., a casting process, a forging process, a milling process, a cutting process, a grinding process, a welding process, a combination thereof, etc.). The body portion 3210 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 3210 may be partially or entirely made of non-metal material (e.g., composite, plastic, etc.). The golf club head 3200 may be a putter-type golf club head (e.g., a blade-type putter, a mid-mallet-type putter, a mallet-type putter, etc.). Based on the type of putter as mentioned above, the body portion 3210 may be at least 200 grams. For example, the body portion 3210 may be in a range between 300 to 600 grams. Although FIG. 31 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The body portion 3210 may include a hosel portion 3245 configured to receive a shaft (not shown) with a grip (not shown) on one end and the golf club head 3200 on the opposite end of the shaft to form a golf club. The front and rear portions 3250 and 3260, respectively, may be on opposite ends of the body portion 3210. The front portion 3250 may include a face portion 3255 (e.g., a strike face). The face portion 3255 may be used to impact a golf ball (one shown as 500 in FIG. 5). The face portion 3255 may be associated with a loft plane that defines the loft angle of the golf club head 3200. The apparatus, methods, and articles of manufacture described herein are not limited in this regard.

The body portion 3210 may include one or more weight ports and one or more weight portions similar to any of the golf club heads described herein. For example, the body portion 3210 may include a first set of weight ports 3320 on the rear portion 3260. In the examples of FIGS. 32-37, the rear portion 3260 includes a back wall portion 3262 having a first weight port 3322 of the first set of weight ports 3320 and a second weight port 3324 of the first set of weight ports 3320. The first weight port 3322 may be closer to the toe portion 3230 than the second weight port 3324. The second weight port 3324 may be closer to the heel portion 3240 than the first weight port 3322. The first and second weight ports 3322 and 3324, respectively, may be at any location on the back wall portion 3262 or the rear portion 3260. The body portion 3210 may not include any weight ports on the back wall portion 3262. The apparatus, methods, and articles of manufacture described herein are not limited in this regard.

Figure 34:
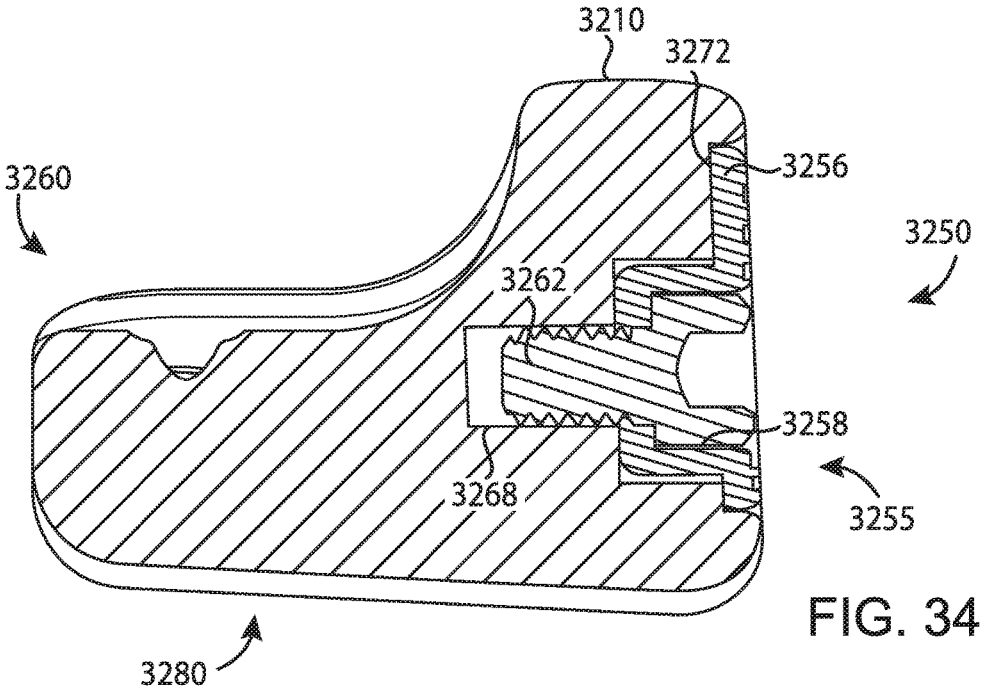
FIG. 34 depicts a cross-sectional view of the golf club head of FIG. 31 at lines 34-34 of FIG. 32.
Figure 35:
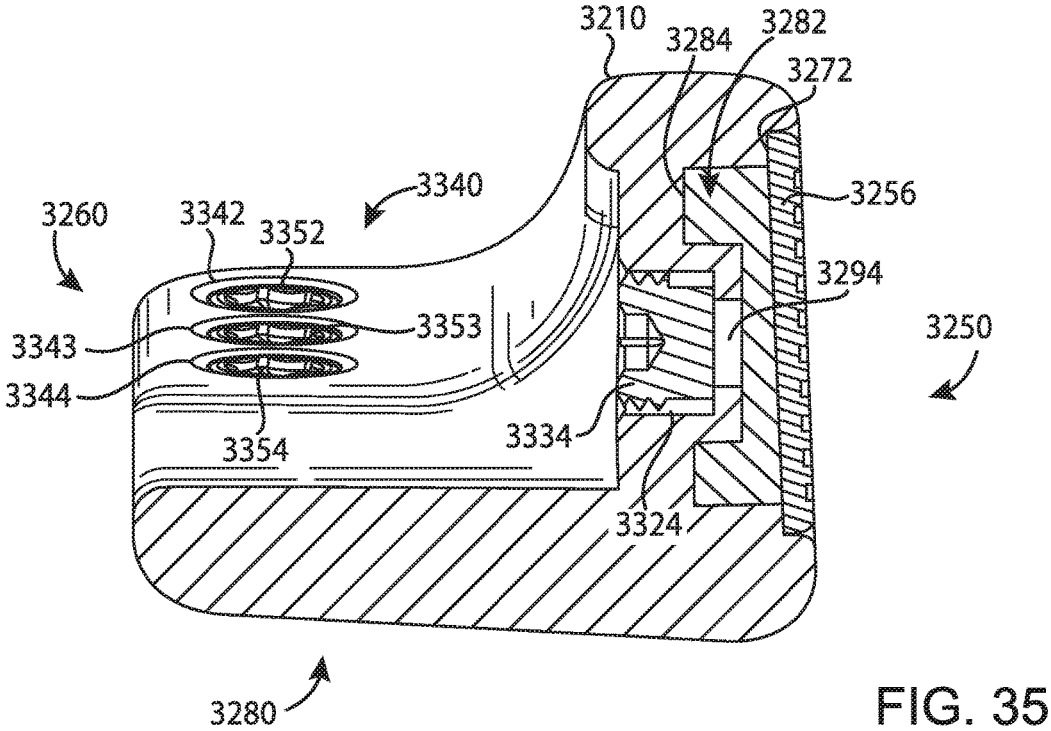
FIG. 35 depicts a cross-sectional view of the golf club head of FIG. 31 at lines 35-35 of FIG. 33.

In the example of FIGS. 32-37, the body portion 3210 may include a second set of weight ports 3340 as shown in FIG. 35 proximate to the heel portion 3240 and extending between the toe portion 3230 and the heel portion 3240. The second set of weight ports 3340 may include any number of weight ports, such as three weight port as shown in FIG. 34 as weight ports 3342, 3343 and 3344. The body portion 3210 may include a third set of weight ports 3360 that may be located near the toe portion and extend between the toe portion 3230 and the heel portion 3240. The third set of weight ports 3360 may include any number of weight ports, such as three weight port similar to the weight ports of the second set of weight ports 3340. The second and third sets of weight ports 3340 and 3360, respectively, may be similar to each other and symmetrically arranged relative to a midpoint of the body portion 3210. The apparatus, methods, and articles of manufacture described herein are not limited in this regard.

Figure 37:
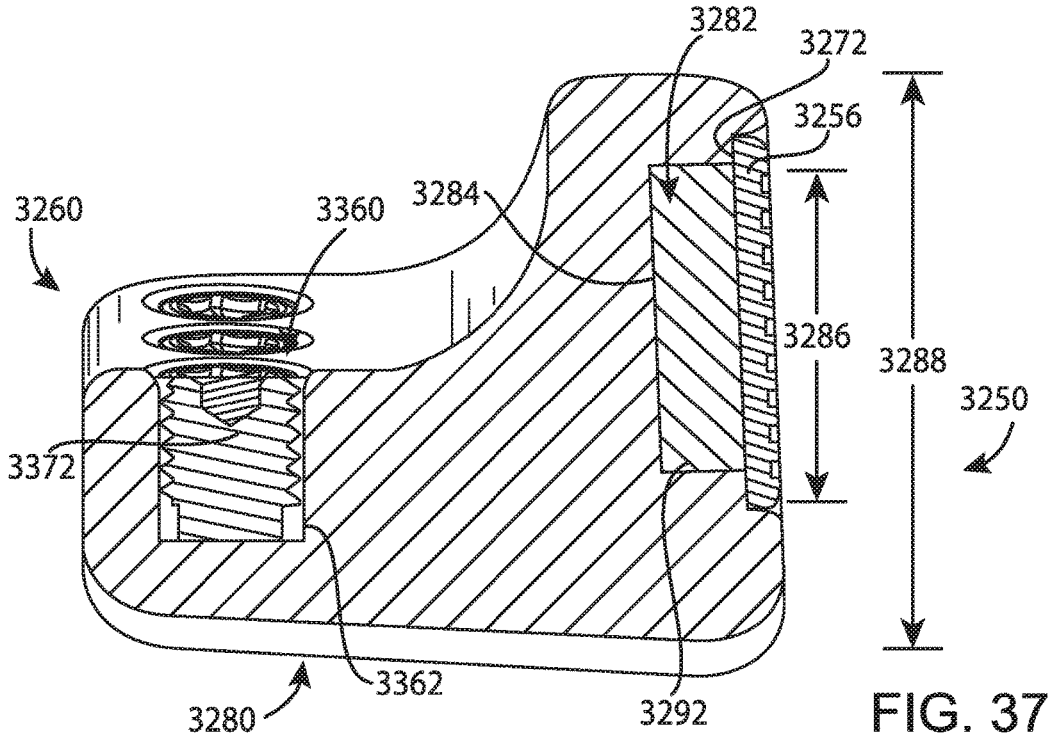
FIG. 37 depicts a cross-sectional view of the golf club head of FIG. 31 at lines 37-37 of FIG. 33.

The golf club head 3200 may include a plurality of weight portions. Each weight port may be configured to receive a weight portion. For example, the weight ports 3322 and 3324 of the first set of weight ports 3320 may receive weight portions 3332 and 3334, respectively. The weight ports 3342, 3343 and 3344 of the second set of weight ports 3340 may receive weight portions 3352, 3353 and 3354, respectively. The weight ports of the third set of weight ports 3360 may receive weight portions similar to the second set of weight ports 3340. In the example of FIG. 37, the weight port 3362 of the third set of weight ports 3360 is shown to have received a weight portion 3372. The configurations of the weight ports and the weight portions (e.g., inner diameter, outer diameter, size, shape, distance from an adjacent weight port or weight portion, etc.) of the golf club head 3200 may be similar in many respects to the weight ports and weight portions of any of the golf club heads descried herein. Accordingly, a detailed description of the weight ports and weight portions of the golf club head 3200 is not described. Alternatively, the body portion 3210 may not include any weight ports and/or weight portions. The apparatus, methods, and articles of manufacture described herein are not limited in this regard.

In the example of FIGS. 32-37, the face portion 3255 may include a separate piece or an insert coupled to the body portion 3210. The face portion 3255 may include a face insert 3256, which may be attached to the front portion via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 32 and 34, the face insert 3256 may include two fastener holes 3258 proximate to the toe portion and heel portion of the face insert 3256. Each of the fastener holes 3258 may be configured to receive a fastener 3262 for attachment of the face insert 3256 to the body portion 3210. The body portion 3210 may include two fastener ports 3268 (one fastener port 3268 shown in FIG. 34) configured to receive the fasteners 3262. Each fastener port 3268 may have internal threads that are configured to engage external threads on the fasteners 3262.

The face portion 3255 may include a peripheral recessed portion 3272 configured to receive the face insert 3256. As shown by example in FIGS. 34-37, the depth of the peripheral recessed portion 3272 may be similar to the thickness of the face insert 3256 such that when the face insert 3256 is fastened to the body portion 3210, the face insert is positioned flush or substantially flush with the face portion 3255. Alternatively, the face insert 3256 may project from the face portion 3255. The apparatus, methods, and articles of manufacture described herein are not limited in this regard.

The fasteners 3262 may have similar or different weights to balance and/or provide heel or toe weight bias for the golf club head 3200. For example, the weight of the body portion 3210 may be increased or decreased by similarly increasing or decreasing, respectively, the weights of the fasteners 3262. In one example, the golf club head may be provided with a toe-biased weight configuration by having the fastener 3262 that is closer to the toe portion 3230 be heavier than the fastener 3262 that is closer to the heel portion 3240. Conversely, the golf club head may be provided with a heel-biased weight configuration by having the fastener that is closer to the heel portion 3240 be heavier than the fastener 3262 that is closer to the toe portion 3230. The apparatus, methods, and articles of manufacture described herein are not limited in this regard.

To attach the face insert 3256 to the body portion 3210, the face insert 3256 may be inserted in the peripheral recessed portion 3272, thereby generally aligning the fastener holes 3258 of the face insert 3256 and the fastener ports 3268 of the body portion 3210. The fasteners 3262 can be inserted through the fastener holes 3258 and screwed into the fastener ports 3268 to securely attach the face insert 3256 to the body portion 3210. The face insert 3256 may be constructed from any material such as metal, metal alloys, plastic, wood, composite materials or a combination thereof to provide a certain ball striking characteristic to the golf club head 3200. The material from which the face insert 3256 is manufactured may affect ball speed and spin characteristics. Accordingly, the face insert 3256 may be selected to provide a certain ball speed and spin characteristics for an individual. Thus, the face insert 3256 may be interchangeable with other face inserts 3256 having different ball speed and spin characteristics. The face insert 3256 may be coupled to the body portion 3210 by other methods or devices, such as by bonding, welding, adhesive and/or other types of fastening devices and/or methods. The apparatus, methods, and articles of manufacture described herein are not limited in this regard.

Figure 36:
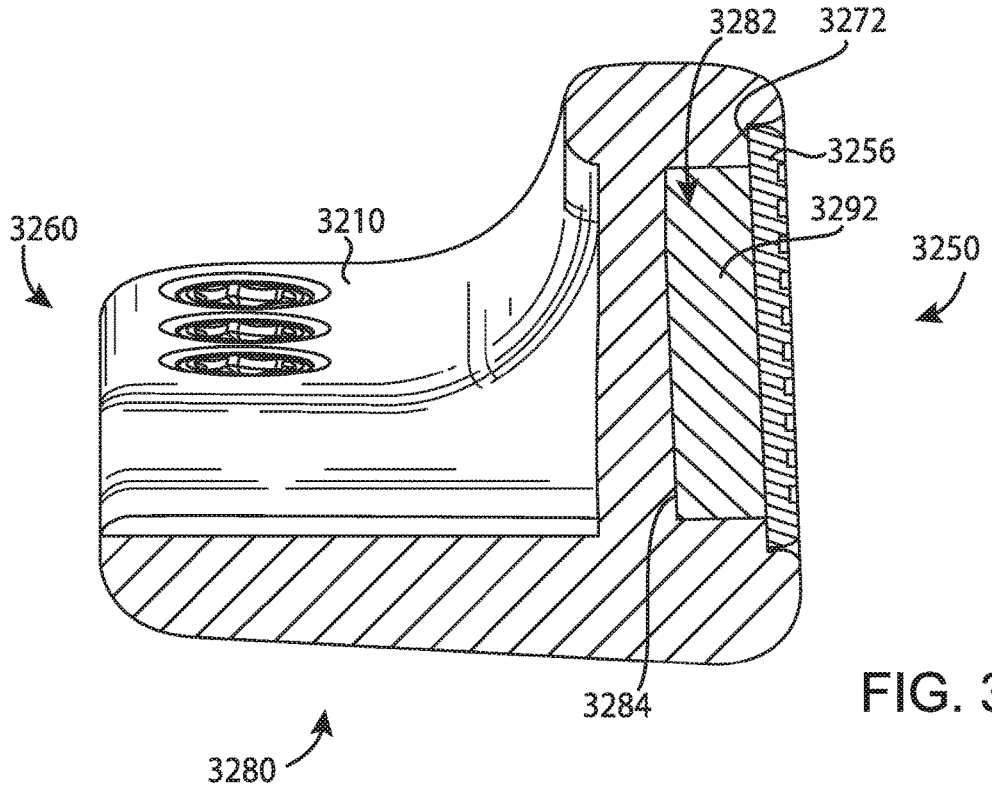
FIG. 36 depicts a cross-sectional view of the golf club head of FIG. 31 at lines 36-36 of FIG. 33.

The body portion 3210 may include an interior cavity 3282 extending between the front portion 3250 and the rear portion 3260 and between the toe portion 3230 and the heel portion 3240. In one example as shown in FIGS. 35-37, the interior cavity 3282 may be defined by a recess 3284 in the front portion 3250 that is covered by the face insert 3256. The recess 3284 may extend from near the toe portion 3230 to near the heel portion 3240 and from near the top portion 3270 to near the sole portion 3280. Alternatively, the recess 3282 may extend between the fastener ports 3268 of the body portion 3210. In one example, the recess 3282 may be located in and/or near the regions of the face portion 3255 that generally strike a golf ball. The apparatus, methods, and articles of manufacture described herein are not limited in this regard.

The interior cavity 3282 may be associated with a cavity height 3286 ($H_C$), and the body portion 3210 may be associated with a body height 3288 ($H_B$). While the cavity height 3286 and the body height 3288 may vary between the toe and heel portions, the cavity height 3286 may be at least 50% of a body height 3288 ($H_C>0.5*H_B$). For example, the cavity height 3286 may vary between 70% and 85% of the body height 3288. With the cavity height 3285 of the interior cavity 3282 being greater than 50% of the body height 3288, the golf club head 3200 may produce relatively more consistent feel, sound, and/or result when the golf club head 3200 strikes a golf ball via the face portion 3255 than a golf club head with a cavity height of less than 50% of the body height. However, the cavity height 3286 may be less than 50% of the body height 3288. The apparatus, methods, and articles of manufacture described herein are not limited in this regard.

In one example, the interior cavity 3282 may be unfilled (i.e., empty space). Alternatively, the interior cavity 3282 may be partially or entirely filled with a filler material 3292 to absorb shock, isolate vibration, and/or dampen noise when the face portion 3255 strikes a golf ball. The filler material 3292 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3282 may be filled with a TPE material to absorb shock, isolate vibration, and/or dampen noise when the golf club head 3200 strikes a golf ball via the face portion 3255. The apparatus, methods, and articles of manufacture described herein are not limited in this regard.

In another example, the filler material 3292 may be a polymer material such as an ethylene copolymer material to absorb shock, isolate vibration, and/or dampen noise when the golf club head 3200 strikes a golf ball via the face portion 3255. In particular, at least 50% of the interior cavity 3282 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3282 may be partially or fully filled with the filler material 3292. In one example, the recess 3284 may be filled with the filler material 3292 prior to attaching the face insert 3256 to the face portion 3255. In one example, the interior cavity 3282 may be filled with the filler material 3292 via any one of the weight ports 3322 or 3324 of the first set of weight ports 3320. In one example as shown in FIG. 35, the weight port 3324 may be connected to the interior cavity 3282 via an opening 3294. Similarly, the weight port 3322 may be connected to the interior cavity 3282 via an opening (not shown). The filler material 3292 may be injected in the interior cavity 3282 from the weight port 3324 via the opening 3294. As the filler material 3292 fills the interior cavity 3282, the air inside the interior cavity 3282 that is displaced by the filler material 3292 may exit the interior cavity 3282 from the weight port 3322 through the opening (not shown) that connects the weight port 3322 to the interior cavity 3282. Accordingly, the weight port 3322 may function as an exit port for the displaced air inside the interior cavity 3282. After the interior cavity 3282 is partially or fully filled with the filler material 3292, the weight ports 3322 and 3324 may be closed by inserting and securing weight portions 3332 and 3334, respectively, therein as described in detail herein. Alternatively, the filler material 3292 may be injected in the interior cavity 3282 from the weight port 3322, while the weight port 3324 functions as an exit port for the displaced air inside the interior cavity 3282. The apparatus, methods, and articles of manufacture described herein are not limited in this regard.

For example, at least 50% of the interior cavity 3282 may be filled with the filler material 3292 to absorb shock, isolate vibration, dampen noise, and/or provide structural support when the golf club head 3200 strikes a golf ball via the face portion 3255. With the support of the back wall portion 3284 and filling at least a portion of the interior cavity 3282 with the filler material 3292, the face portion 3255 may be relatively thin without degrading the structural integrity, sound, and/or feel of the golf club head 3200. In one example, the face portion 3255 may have a thickness of less than or equal to 0.075 inch (e.g., the thickness of the cavity wall portion 3284). In another example, the face portion 3255 may have a thickness of less than or equal to 0.060 inch. In yet another example, the face portion 3255 may have a thickness of less than or equal to 0.050 inch. Further, the face portion 3255 may have a thickness of less than or equal to 0.030 inch. The apparatus, methods, and articles of manufacture described herein are not limited in this regard. The apparatus, methods, and articles of manufacture described herein may be implemented in a variety of examples, and the foregoing description of some of these examples does not necessarily represent a complete description of all possible examples. Instead, the description of the drawings, and the drawings themselves, disclose at least one example, and may disclosure alternative examples.

In one example, the face portion 3255 may be in one-piece with the body portion 3210 or be an integral part of the body portion 3210 (not shown). The body portion 3210 may include an interior cavity near the face portion 3255 that may be similar in many respects to the interior cavity 3282. However, unlike the interior cavity 3282 which may be partially defined by the face insert 3256, an interior cavity of the body portion 3210 having a one-piece face portion 3255 may be an integral part of the body portion 3210. The interior cavity may be partially or fully filled with a filler material 3292 via the weight ports 3322 and/or 3324 as described in detail herein. The apparatus, methods, and articles of manufacture described herein are not limited in this regard.

Figure 38:
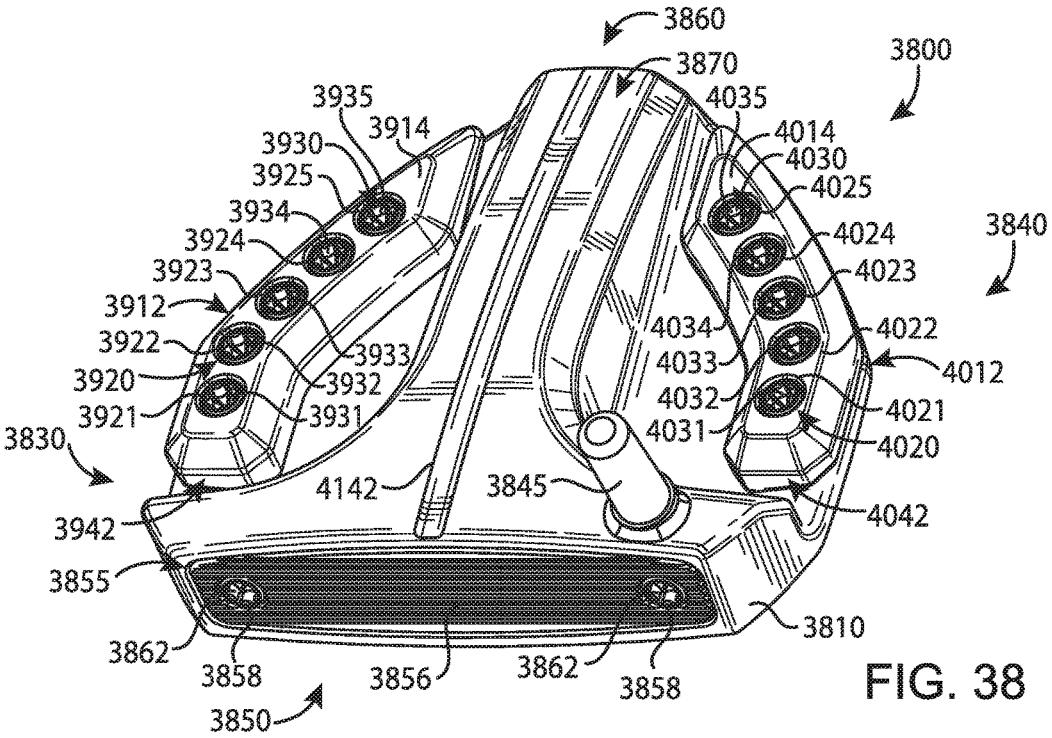
FIG. 38 depicts a front and top perspective view of a golf club head according to yet another example of the apparatus, methods, and articles of manufacture described herein.

In the example of FIG. 38, a golf club head 3800 may include a body portion 3810. The body portion 3810 may include a toe portion 3830, a heel portion 3840, a front portion 3850, a rear portion 3860, a top portion 3870, and a sole portion 3880. The body portion 3810 may be manufactured via various manufacturing methods and/or processes (e.g., a casting process, a forging process, a milling process, a cutting process, a grinding process, a welding process, a combination thereof, etc.). The body portion 3810 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 3810 may be partially or entirely made of non-metal material (e.g., composite, plastic, etc.). The golf club head 3800 may be a putter-type golf club head (e.g., a blade-type putter, a mid-mallet-type putter, a mallet-type putter, etc.). Based on the type of putter as mentioned above, the body portion 3810 may be at least 200 grams. For example, the body portion 3810 may be in a range between 300 to 600 grams. Although FIG. 38 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The body portion 3810 may include a hosel portion 3845 configured to receive a shaft (not shown) with a grip (not shown) on one end and the golf club head 3800 on the opposite end of the shaft to form a golf club. Alternatively, the body portion 3810 may include a bore (not shown) for receiving the shaft (not shown). The front and rear portions 3850 and 3860, respectively, may be on opposite ends of the body portion 3810. The front portion 3850 may include a face portion 3855 (e.g., a strike face). The face portion 3855 may be used to impact a golf ball (one shown as 500 in FIG. 5). The face portion 3855 may be associated with a loft plane that defines the loft angle of the golf club head 3800. The apparatus, methods, and articles of manufacture described herein are not limited in this regard.

As illustrated in FIG. 38, for example, the body portion 3810 may include two or more weight regions, generally shown as a first weight region 3912 and a second weight region 4012. The first weight region 3912 may include a first weight platform portion 3914 having a first set of weight ports 3920 (e.g., shown as weight ports 3921, 3922, 3923, 3924, and 3925). Each weight port of the first set of weight ports 3920 is configured to receive a weight portion of a first set of weight portions 3930 (e.g. show as weight portions 3931, 3932, 3933, 3934 and 3935). The second weight region 4012 may include a second weight platform portion 4014 having a second set of weight ports 4020 (e.g., shown as weight ports 4021, 4022, 4023, 4024, and 4025). Each weight port of the second set of weight ports 4020 is configured to receive a weight portion of a second set of weight portions 4030 (e.g. show as weight portions 4031, 4032, 4033, 4034 and 4035). Each weight portion of the first set of weight portions 3930 may be interchangeable with each weight portion of the second set of weight portions 4030. Accordingly, each weight port of the first set of weight ports 3920 and the second set of weight ports 4020 may be configured to interchangeably receive any of the weight portions of the first set of weight portions 3930 or the second set of weight portions 4030.

The first weight platform portion 3914 and the second weight platform portion 4014 may have a weight platform portion length 4015 ($L_{wp}$) that may be greater than about 40% of the body portion length 3895 ($L_B$). In one example, the weight platform portion length 4015 may be greater than 50% of the body portion length 3895. In one example, the weight platform portion length 4015 may be greater than 60% of the body portion length 3895. In one example, the weight platform portion length 4015 may be greater than 70% of the body portion length 3895. Accordingly, the mass of each weight platform portion 3914 and 4014 may be distributed along a substantial portion of the body portion length 3895. The apparatus, methods, and articles of manufacture described herein are not limited in this regard.

The masses of the first and second weight platform portions 3914 and 4014 may be moved laterally outward on the body portion 3810. The mass of each weight platform portion may be between 5% and 30% of the mass of the body portion 3810 including the mass of the first weight platform portion 3914 and second weight platform portion 4014. In one example, the mass of each weight platform portion may be between about 3% and about 13% of the mass of the body portion 3810 if the weight platform portions are made from relatively lighter metals such as metals including titanium or titanium alloys. In another example, the mass of each weight platform portion may be between about 8% and about 21% of the mass of the body portion 3810 if the weight platform portions are made from metals including steel. In yet another example, the mass of each weight platform portion may be between about 10% and about 30% of the mass of the body portion 3810 if the weight platform portions are made from relatively heavier metals such as metals including magnesium or magnesium alloys. Accordingly, between about 3% and about 30% of the mass of the body portion may be redistributed to the toe portion 3830 and the heel portion 3840 by the weight platform portions 3914 and 4014 from other parts of the body portion 3810. Further, the first weight platform portion 3914 may be located at or proximate to the periphery of the toe portion 3830 and the second weight platform portion 4014 may be located at or proximate to the periphery of the heel portion 3840. The apparatus, methods, and articles of manufacture described herein are not limited in this regard.

Each weight port of the first set of weight ports 3920 may have a first port diameter ($PD_1$). In particular, a uniform distance of less than the first port diameter may separate any two adjacent weight ports of the first set of weight ports 3920 (e.g., (i) weight ports 3921 and 3922, (ii) weight ports 3922 and 3923, (iii) weight ports 3923 and 3924, or (iv) weight ports 3924 and 3925). In one example, the first port diameter may be about 0.25 inch and any two adjacent weight ports of the first set 3920 may be separated by 0.1 inch. Each weight port of the second set of weight ports 4020 may have a second diameter ($PD_2$). A uniform distance of less than the second port diameter may separate any two adjacent weight ports of the second set 4020 (e.g., (i) weight ports 4021 and 4022, (ii) weight ports 4022 and 4023, (iii) weight ports 4023 and 4024, or (iv) weight ports 4024 and 4025). The first and second port diameters may be equal to each other (i.e., $PD_1=PD_2$). For example, a the second port diameter may be about 0.25 inch and any two adjacent weight ports of the second set 4020 may be separated by 0.1 inch. The first and second port diameters may be different. The apparatus, methods, and articles of manufacture described herein are not limited in this regard.

The first weight platform portion 3914, the first set of weight ports 3920 (weight ports 3921, 3922, 3923, 3924, and 3925), and/or the first set of weight portions 3930 (weight portions 3931, 3932, 3933, 3934 and 3935) may form a first visual guide portion 3942. The second weight platform portion 4014, the second set of weight ports 4020 (weight ports 4021, 4022, 4023, 4024, and 4025), and/or the second set of weight portions 4030 (weight portions 4031, 4032, 4033, 4034 and 4035) may form a second visual guide portion 4042. The first weight region 3912 may be located at or proximate to a periphery of the toe portion 3830 of golf club head 3800. Accordingly, the first visual guide portion 3942 may be located at or proximate to the periphery of the toe portion 3830. The second weight region 4012 may be located at or proximate to the periphery of the heel portion 3840 of the golf club head 3800. Accordingly, the second visual guide portion 4042 may be located at or proximate to the periphery of the heel portion 3840. The first weight platform portion 3914 and/or any of the weight portions of the first set of weight portions 3930 may have distinct colors, markings and/or other visual features so as to be visually distinguished from the surrounding portions of the body portion 3810. Similarly, the second weight platform portion 3914 and/or any of the weight portions of the second set of weight portions 4030 may have distinct colors, markings and/or other visual features so as to be visually distinguished from the surrounding portions of the body portion 3810. The apparatus, methods, and articles of manufacture described herein are not limited in this regard.

The golf club head 3800 may also include a third visual guide portion 4142, which may be substantially equidistant from the first and second visual guide portions 3942 and 4042. For example, the third visual guide portion 4042 may extend between the front and rear portions 3850 and 3860 located at or proximate to a center of the body portion 3810. The third visual guide portion 4142 may be the same as or different from the first and/or second visual guide portions 3942 and 4042, respectively. In one example, the third visual guide portion 4142 may be a recessed line portion having a certain color. In another example, the third visual guide portion 4142 may include a plurality of weight ports (not shown) with a plurality of weight portions (not shown) received therein. Alternatively, the third visual guide portion 4142 may be defined by a raised portion of the top portion 3870. The third visual guide portion 4142 may be similar in many respects to any of the visual guide portions described herein. Therefore, a detailed description of the third visual guide portion 4142 is not provided. The apparatus, methods, and articles of manufacture described herein are not limited in this regard.

The first and second sets of weight portions 3930 and 4030, respectively, may have similar or different physical properties (e.g., density, shape, mass, volume, size, color, etc.). The first and second sets of weight portions 3930 and 4030, respectively, may include threads to secure in the weight ports of the first and second sets of weight ports 3920 and 4020, respectively. The physical properties of the weight portions of the first and second sets of weight portions 3930 and 4030, respectively, may be similar in many respects to any of the weight portions described herein. Therefore, a detailed description of the physical properties of the weight portions of the first and second sets of weight portions 3930 and 4030, respectively, is not provided. The apparatus, methods, and articles of manufacture described herein are not limited in this regard.

The first weight platform portion 3914 may be attached to the body portion 3810 with any one or more of weight portions of the first set of weight portions 3930 or the second set of weight portions 4030. The body portion may include a plurality of toe side threaded bores (not shown) on the top portion 3870 at or proximate to the toe portion 3830. When the first weight platform portion 3914 is placed on the top portion 3870 at or proximate to the periphery of the toe portion 3830 as shown in FIG. 38, the toe side threaded bores may generally align with the weight ports of the first set of weight ports 3920. When a weight portion of the first set of weight portions 3930 or the second set of weight portions 4030 is inserted in a weight port of the first set of weight ports 3920, the weight portion extends through a corresponding one of the toe side threaded bores of the body portion 3810 such that the threads on the weight portion engage the corresponding threads in the toe side threaded bore. The weight portion can then be screwed into the corresponding toe side threaded bore to fasten the first weight platform portion 3914 on the body portion 3810.

The second weight platform portion 4014 may be attached to the body portion 3810 with any one or more of weight portions of the first set of weight portions 3930 or the second set of weight portions 4030. The body portion may include a plurality of heel side threaded bores (not shown) on the top portion 3870 at or proximate to the heel portion 3840. When the second weight platform portion 4014 is placed on the top portion 3870 at or proximate to the periphery of the heel portion 3840 as shown in FIG. 38, the heel side threaded bores generally align with the weight ports of the second set of weight ports 4020. When a weight portion of the first set of weight portions 3930 or the second set of weight portions 4030 is inserted in a weight port of the second set of weight ports 4020, the weight portion extends through a corresponding one of the heel side threaded bores of the body portion 3810 such that the threads on the weight portion engage the corresponding threads in the heel side threaded bore. The weight portion can then be screwed into the corresponding heel side threaded bore to fasten the second weight platform portion 4014 on the body portion 3810.

Each of the weight portions of the first and second sets of weight portions 3930 and 4030, respectively, may have sufficient length to extend through a weight port and into a corresponding threaded bore of the body portion as described herein to fasten the first weight platform portion 3914 and the second weight platform portion 4014 to the body portion 3810. One or more weight portions of the first set of weight portions 3930 and/or one or more weight portions of the second set of weight portions 4030 may function both as weights for configuring a weight distribution of the golf club head 3800 and as fasteners for fastening the first weight platform portion 3914 and/or the second weight platform portion 4014 on the body portion 3810. Alternately, the first weight platform portion 3914 and/or the second weight platform portion 4014 may be fastened on the body portion by using other types of fastening mechanisms such that one or more weight portions of the first set of weight portions 3930 and/or one or more weight portions of the second set of weight portions 4030 may only function as weight portions. The apparatus, methods, and articles of manufacture described herein are not limited in this regard.

Each of the first and second weight platform portions 3914 and 4014, respectively, may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The first and second weight platform portions 3914 and 4014, respectively, may have a similar mass or different masses to optimally affect the weight distribution, center or gravity location and/or moment of inertia of golf club head 3800. Each of the weight platform portions 3912 and 3912 may function as an added weight for the body portion 3810 and as a platform for receiving additional weights for the body portion in the form of the weight portions 3930 and 4030. Thus, the physical properties and the materials of construction of the weight platform portion 3914 and/or 4014 may be determined to optimally affect the weight, weight distribution, center of gravity, moment of inertia characteristics, structural integrity and/or or other static and/or dynamic characteristics of the golf club head 3800.

In one example, the face portion 3855 may be in one-piece with the body portion 3810 or be an integral part of the body portion 3810 (not shown). The face portion 3855 may include a separate piece or an insert coupled to the body portion 3810. The face portion 3855 may include a face insert 3856, which may be attached to the front portion via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIG. 38, the face insert 3856 may include two fastener holes 3858 proximate to the toe portion and heel portion of the face insert 3856. Each of the fastener holes 3858 may be configured to receive a fastener 3862 for attachment of the face insert 3856 to the body portion 3810. The body portion 3810 may include two fastener ports (not shown) configured to receive the fasteners 3862. The fasteners 3862 may be similar or substantially similar to the weight portions of the first set of weight portions 3930 and/or the weight portions of the second set of weight portions 4030. Accordingly, the fasteners 3862 may function both as weights for configuring a weight distribution of the golf club head 3800 and as fasteners for fastening the face insert 3856 to the face portion 3855. The apparatus, methods, and articles of manufacture described herein are not limited in this regard. Each fastener port may have internal threads that are configured to engage external threads on the fasteners 3862. The fastener ports of the body portion 3810 may be similar in many respects to the fastener ports 3268 of the golf club head 3200. The apparatus, methods, and articles of manufacture described herein are not limited in this regard.

The face portion 3855 may include a peripheral recessed portion 3872 (shown in FIG. 46) configured to receive the face insert 3856. As shown by example in FIG. 46, the depth of the peripheral recessed portion 3872 may be similar to the thickness of the face insert 3856 such that when the face insert 3856 is fastened to the body portion 3810, the face insert is positioned flush or substantially flush with the face portion 3855. Alternatively, the face insert 3856 may project from the face portion 3855. The apparatus, methods, and articles of manufacture described herein are not limited in this regard.

As described, the fasteners 3862 may be similar or substantially similar to the weight portions of the first set of weight portions 3930 and/or the weight portions of the second set of weight portions 4030 so that the fasteners 3862 may function to configure the weight distribution of the golf club head 3800. Accordingly, the fasteners 3862 may have similar or different weights to balance and/or provide heel or toe weight bias for the golf club head 3800. For example, the weight of the body portion 3810 may be increased or decreased by similarly increasing or decreasing, respectively, the weights of the fasteners 3862. In one example, the golf club head may be provided with a toe-biased weight configuration by having the fastener 3862 that is closer to the toe portion 3830 be heavier than the fastener 3862 that is closer to the heel portion 3840. Conversely, the golf club head may be provided with a heel-biased weight configuration by having the fastener that is closer to the heel portion 3840 be heavier than the fastener 3862 that is closer to the toe portion 3830. The apparatus, methods, and articles of manufacture described herein are not limited in this regard.

To attach the face insert 3856 to the body portion 3810, the face insert 3856 may be inserted in the peripheral recessed portion 3872, thereby generally aligning the fastener holes 3858 of the face insert 3856 and the fastener ports (not shown) of the body portion 3810. The fasteners 3862 can be inserted through the fastener holes 3858 and screwed into the fastener ports of the body portion 3810 to securely attach the face insert 3856 to the body portion 3810. The face insert 3856 may be constructed from any material such as metal, metal alloys, plastic, wood, composite materials or a combination thereof to provide a certain ball striking characteristic to the golf club head 3800. The material from which the face insert 3856 is manufactured may affect ball speed and spin characteristics. Accordingly, the face insert 3856 may be selected to provide a certain ball speed and spin characteristics for an individual. Thus, the face insert 3856 may be interchangeable with other face inserts 3856 having different ball speed and spin characteristics. The face insert 3856 may be coupled to the body portion 3810 by other methods or devices, such as by bonding, welding, adhesive and/or other types of fastening devices and/or methods. The apparatus, methods, and articles of manufacture described herein are not limited in this regard.

The body portion 3810 may include an interior cavity 3882 (shown in FIG. 46) extending between the front portion 3850 and the rear portion 3860 and between the toe portion 3830 and the heel portion 3840. The interior cavity 3882 may be open or accessible at the face portion 3855 and/or at the sole portion 3880. Accordingly, the interior cavity 3882 may have a first opening 4176 at the face portion 3855 and/or a second opening 4178 at the sole portion 3880. The interior cavity 3882 allows the mass of the body portion 3810 to be removed at or around the center portion of the body portion 3810 so that removed mass may be redistributed to the toe portion 3830 and the heel portion 3840 using the first weight platform portion 3914 and the second weight platform portion 4014 without affecting or substantially affecting the overall mass of the golf club head 3800.

Figure 43:
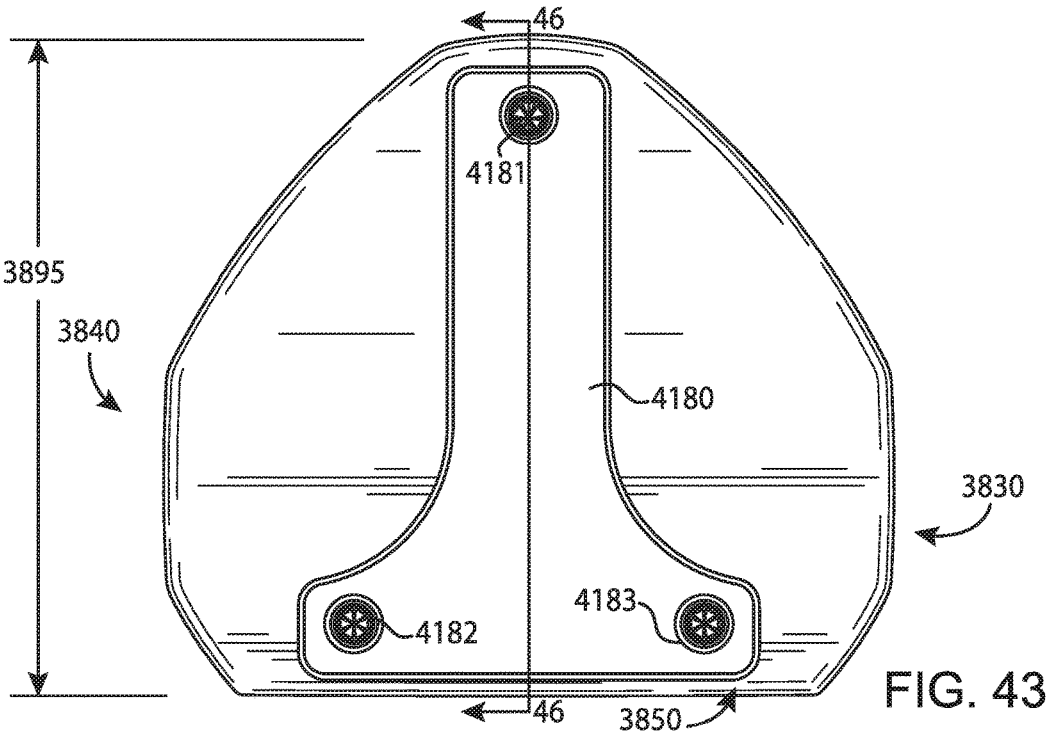
FIG. 43 depicts a bottom view of the golf club head of FIG. 38.
Figure 44:
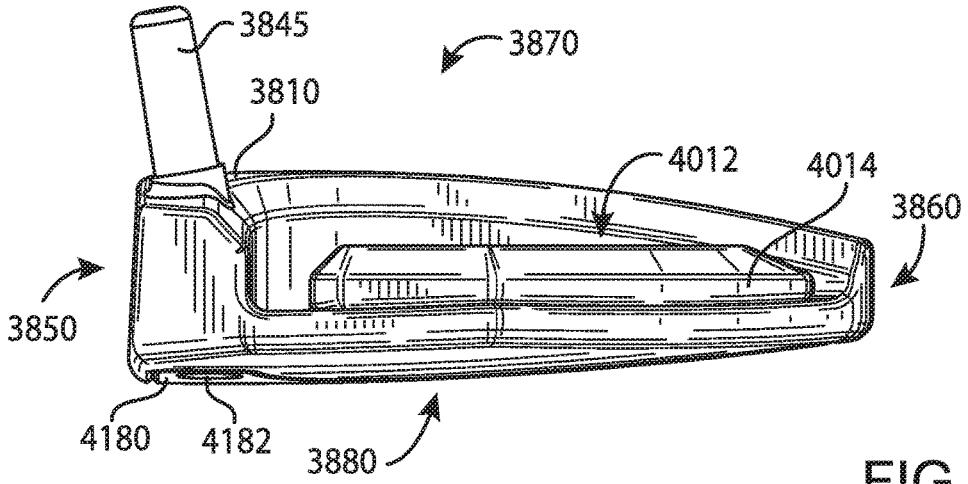
FIG. 44 depicts a heel side view of the golf club head of FIG. 38.
Figure 45:
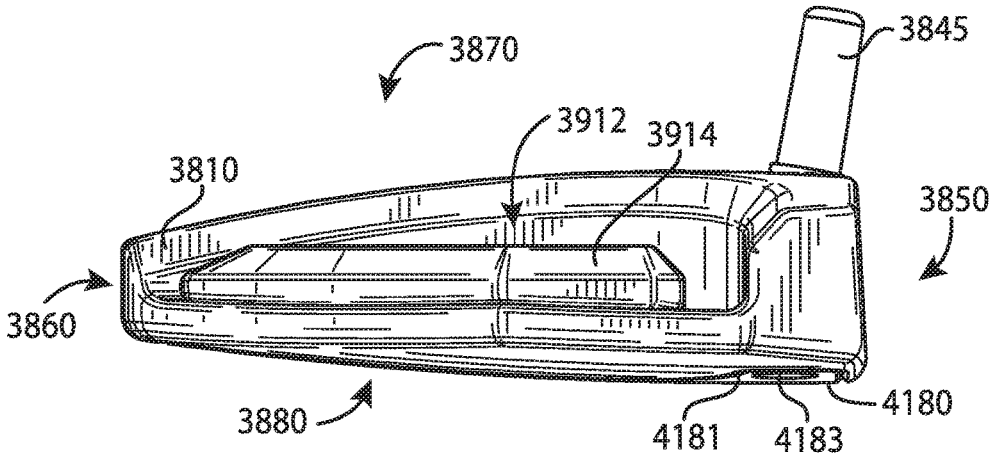
FIG. 45 depicts a toe side view of the golf club head of FIG. 38.
Figure 46:
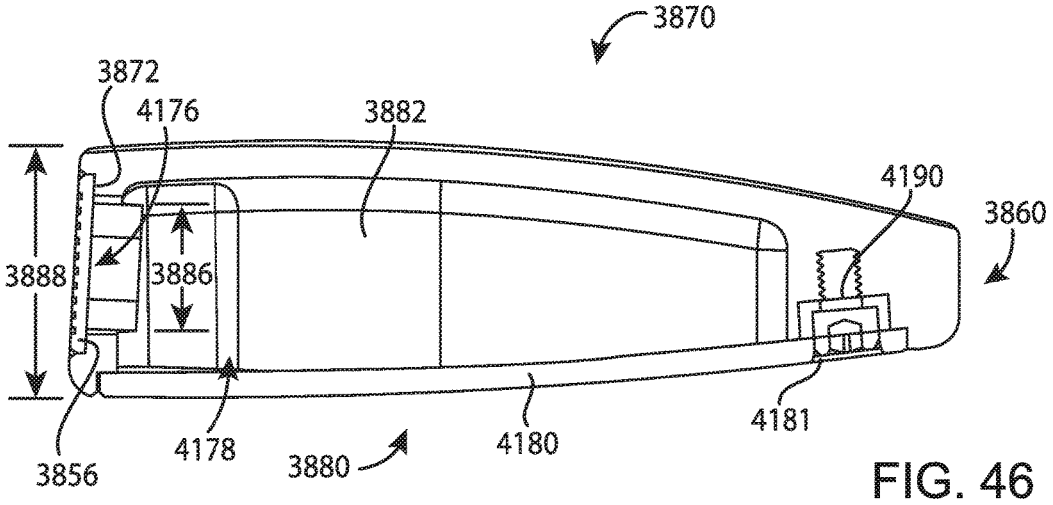
FIG. 46 depicts a cross-sectional view of the golf club head of FIG. 38 taken at 46-46 of FIG. 43.

In one example as shown in FIGS. 43 and 46, the interior cavity 3882 may be covered at the face portion 3855 by the face insert 3856 and at the sole portion 3880 by a cover or sole plate 4180. In one example, the sole plate 4180 may have a mass between 7% and 17% of the mass of the golf club head 3800. In one example, the sole plate may have a mass between 10% and 15% of the mass of the golf club head 3800. As described herein, the interior cavity 3882 allows the mass of the body portion 3810 to be removed at or around the center portion of the body portion 3810. The removed mass can be also redistributed to the sole portion 3880 using the sole plate 4180 to lower the center of gravity of the golf club head 3800 without affecting or substantially affecting the overall mass of the golf club head 3800. The apparatus, methods, and articles of manufacture described herein are not limited in this regard.

Figure 39:
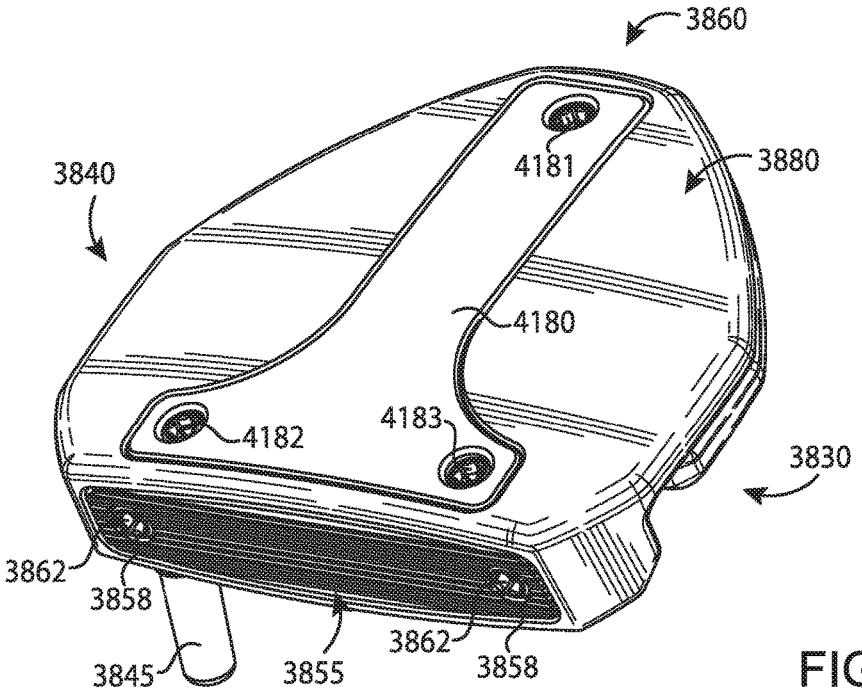
FIG. 39 depicts a front and bottom perspective view of the golf club head of FIG. 38.
Figure 40:
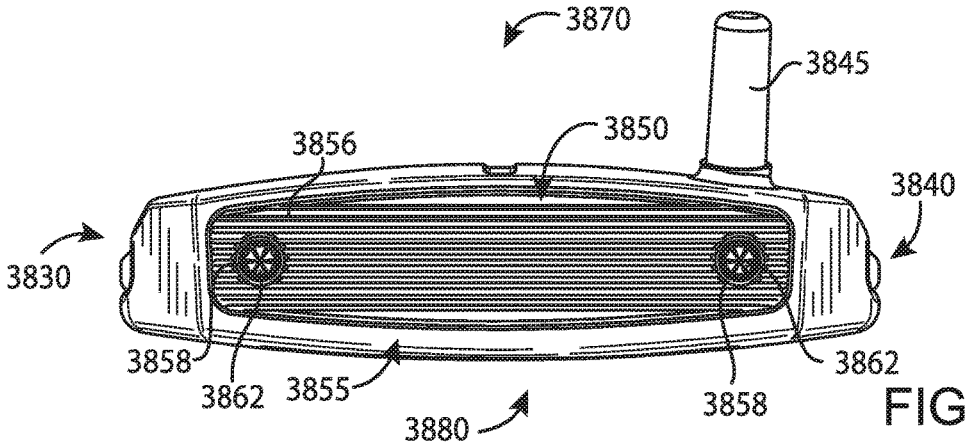
FIG. 40 depicts a front view of the golf club head of FIG. 38.
Figure 41:
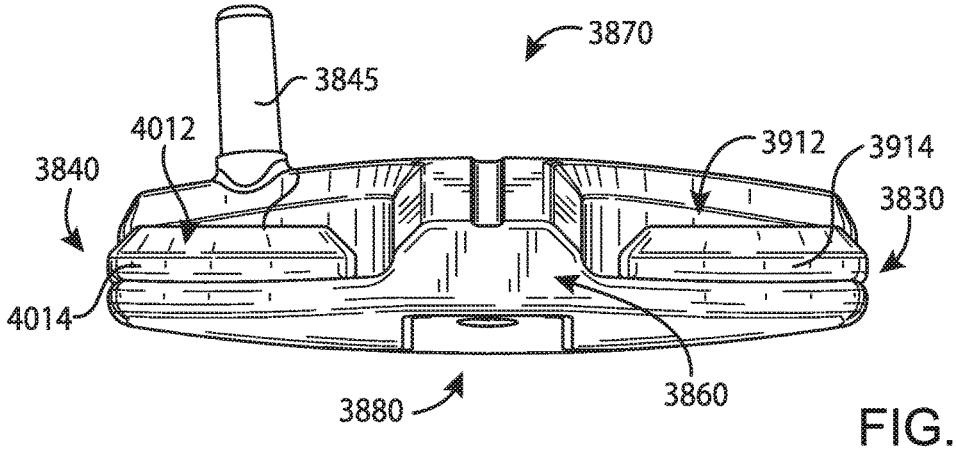
FIG. 41 depicts a back view of the golf club head of FIG. 38.
Figure 42:
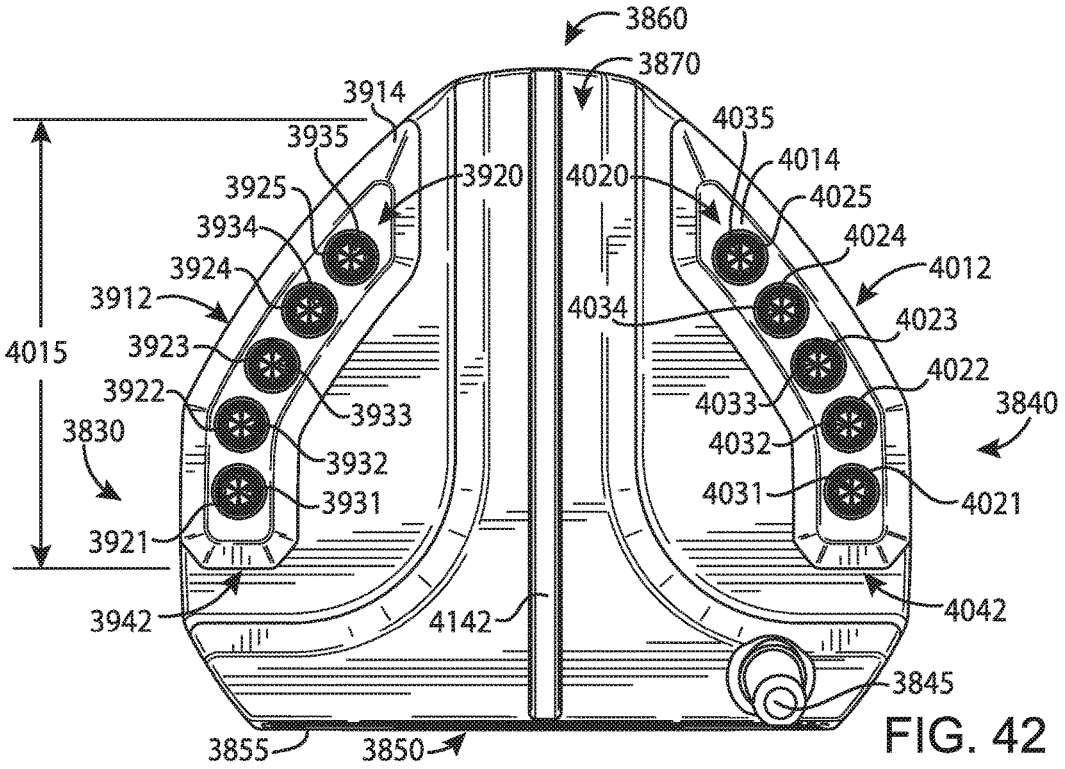
FIG. 42 depicts a top view of the golf club head of FIG. 38.

The sole plate 4180 may be attached to the sole portion 3880 with one or more fasteners. In the example of FIG. 39, the sole plate 4180 may be attached to the sole portion 3880 with fasteners 4181, 4182 and 4183 to cover the second opening 4178 of the interior cavity 3882 at the sole portion 3880. Each of the fasteners 4181, 4182 and 4183 may have a threaded portion that is configured to engage a correspondingly threaded bore 4190 (shown in FIG. 46) in the body portion 3810. The fasteners 4181, 4182 and/or 4183 may be similar or substantially similar to the weight portions of the first set of weight portions 3930 and/or the weight portions of the second set of weight portions 4030. Accordingly, the fasteners 4181, 4182 and/or 4183 may function both as weights for configuring a weight distribution of the golf club head 3800 and as fasteners for fastening the sole plate 4180 to the sole portion 4080. The fasteners 4181, 4182 and/or 4183 may also lower the center of gravity of the golf club head 3800 by adding more mass to the sole portion 3880 without affecting or substantially affecting the overall mass of the golf club head 3800 as described herein with respect to the sole plate 4180. The apparatus, methods, and articles of manufacture described herein are not limited in this regard.

The sole plate may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The physical properties and the materials of construction of the sole plate 4180 may be determined to optimally affect the weight, weight distribution, center of gravity, moment of inertia characteristics, structural integrity and/or or other static and/or dynamic characteristics of the golf club head 3800.

The interior cavity 3882 may extend from near the toe portion 3830 to near the heel portion 3840 and from near the top portion 3870 to near the sole portion 3880. Alternatively, the interior cavity may extend between front portion 3850 and the rear portion 3860 and include a portion of the body portion 3810 between the toe portion 3830 and near the heel portion 3840 and between the top portion 3870 and near the sole portion 3880. In one example, a portion of the interior cavity 3882 may be located proximate to the regions of the face portion 3855 that generally strike a golf ball. In one example, the interior cavity 3882 may be only at face portion 3855 similar to the interior cavity 3282 of the golf club head 3200. The apparatus, methods, and articles of manufacture described herein are not limited in this regard.

The interior cavity 3882 proximate to the face portion 3855 may be associated with a cavity height 3886 ($H_C$), and the body portion 3810 proximate to the face portion 3855 may be associated with a body height 3888 ($H_B$). While the cavity height 3886 and the body height 3888 may vary between the toe and heel portions, the front and rear portions, and the top and sole portions, the cavity height 3886 may be at least 50% of a body height 3888 ($H_C>0.5*H_B$) proximate to the face portion 3855 or an any location of the interior cavity 3882. For example, the cavity height 3886 may vary between 70% and 85% of the body height 3888. With the cavity height 3885 of the interior cavity 3882 being greater than 50% of the body height 3888, the golf club head 3800 may produce relatively more consistent feel, sound, and/or result when the golf club head 3800 strikes a golf ball via the face portion 3855 than a golf club head with a cavity height of less than 50% of the body height. However, the cavity height 3886 may be less than 50% of the body height 3888. The apparatus, methods, and articles of manufacture described herein are not limited in this regard.

In one example, the interior cavity 3882 may be unfilled (i.e., empty space). Alternatively, the interior cavity 3882 may be partially or entirely filled with a filler material (not shown) to absorb shock, isolate vibration, and/or dampen noise when the face portion 3855 strikes a golf ball. The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3882 may be filled with a TPE material to absorb shock, isolate vibration, and/or dampen noise when the golf club head 3800 strikes a golf ball via the face portion 3855. In one example, the mass of the filler material (e.g., TPE, TPU, etc.) may be between 3% and 13% of the mass of the golf club head 3800. In one example, the mass of the filler material may be between 6% and 10% of the mass of the golf club head 3800. The apparatus, methods, and articles of manufacture described herein are not limited in this regard.

In another example, the filler material may be a polymer material such as an ethylene copolymer material to absorb shock, isolate vibration, and/or dampen noise when the golf club head 3800 strikes a golf ball via the face portion 3855. In particular, at least 50% of the interior cavity 3882 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3882 may be partially or fully filled with the filler material 3892. In one example, the interior cavity 3882 may be filled with the filler material from the first opening 4176 and/or the second opening 4178 prior to attaching the face insert 3856 and/or the sole plate 4180, respectively, to the body portion 3810. In one example, the interior cavity 3882 may be filled with the filler material after the face insert 3856 and the sole plate 4180 are attached to the body portion 3810 by injecting the filler material into the interior cavity 3882 through one or more ports (not shown) on the sole plate 4180. The filler material may be injected into the interior cavity 3882 from one or more ports on the sole plate 4180, while the air inside the interior cavity 3882 that is displaced by the filler material may exit the interior cavity 3882 from one or more other ports on the sole plate 4180.

For example, at least 50% of the interior cavity 3882 may be filled with the filler material to absorb shock, isolate vibration, dampen noise, and/or provide structural support when the golf club head 3800 strikes a golf ball via the face portion 3855. With the filler material, the face portion 3855 may be relatively thin without degrading the structural integrity, sound, and/or feel of the golf club head 3800. In one example, the face portion 3855 may have a thickness of less than or equal to 0.075 inch (e.g., the thickness of the cavity wall portion 3882). In another example, the face portion 3855 may have a thickness of less than or equal to 0.060 inch. In yet another example, the face portion 3855 may have a thickness of less than or equal to 0.050 inch. Further, the face portion 3855 may have a thickness of less than or equal to 0.030 inch. The apparatus, methods, and articles of manufacture described herein are not limited in this regard. The apparatus, methods, and articles of manufacture described herein may be implemented in a variety of examples, and the foregoing description of some of these examples does not necessarily represent a complete description of all possible examples. Instead, the description of the drawings, and the drawings themselves, disclose at least one example, and may disclosure alternative examples.

Figure 47:
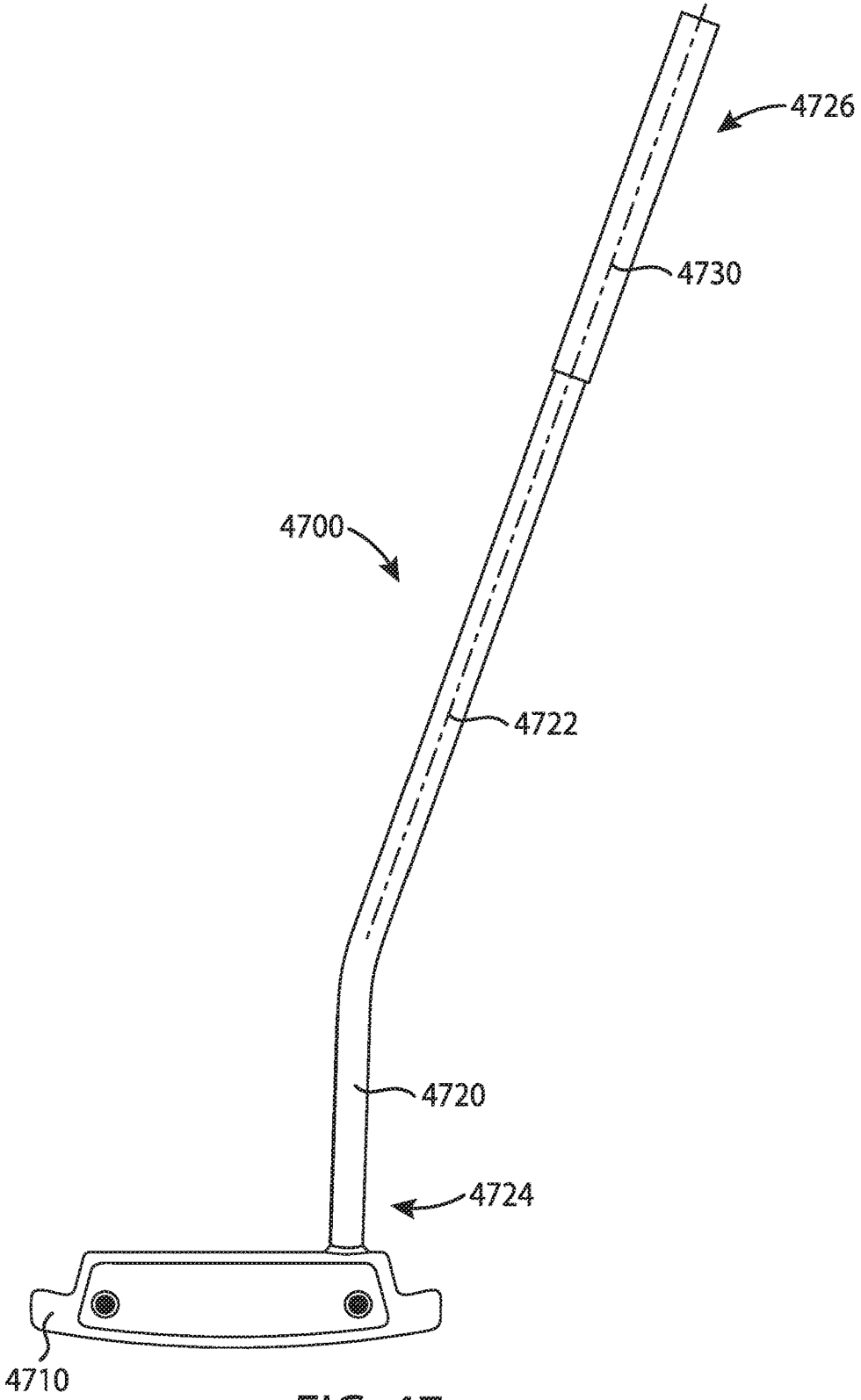
FIG. 47 depicts a front perspective view of a golf club according to another example of the apparatus, methods, and articles of manufacture described herein.
Figure 48:
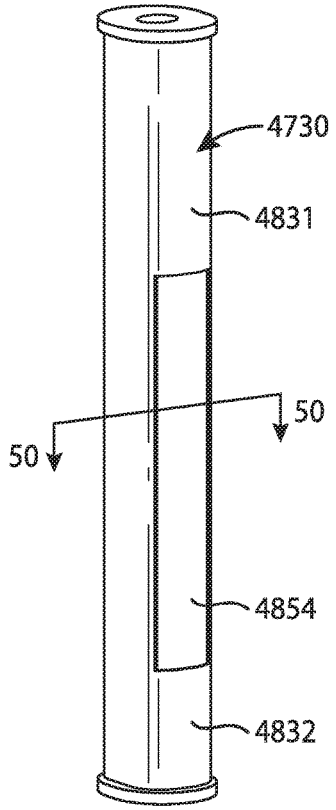
FIG. 48 depicts a side perspective view of a grip for a golf club according to an example of the apparatus, methods and articles of manufacture described herein.

In the example of FIG. 47, a golf club 4700 may include a golf club head 4710, a shaft 4720 connected to the golf club head 4710 at a first end portion 4724 of the shaft 4720, and a grip portion 4730 connected to the shaft 4720 at a second end portion 4726 of the shaft 4720 and by which an individual can hold and swing the golf club 4700. The shaft 4720 includes a shaft axis 4722, which may be a center axis of the shaft 4720. The golf club 4700 may be any type of golf club or may be similar to a golf club with any of the golf club heads described herein. The apparatus, methods, and articles of manufacture described herein are not limited in this regard.

The grip portion 4730 may include a grip body 4831 that may have a circular, an oval, an elliptical, or other suitable cross-sectional shape (e.g., a rectangular cross-sectional shape having rounded edges or rounded sides). The grip body 4831 may include a grip core portion 4832. The grip core portion 4832 may include a center bore 4834 for receiving the second end portion 4726 of the shaft 4720. The grip portion 4730 may also include a grip cover portion 4836 that may cover or envelope all or portions of the core portion 4832. The grip cover portion 4836 may provide a suitable outer surface texture and elasticity when an individual is holding the grip portion 4730. The grip cover portion 4836 may a grip tape or a grip sleeve that may be made from foam, rubber, one or more spongy materials, cork, or other suitable materials. The apparatus, methods, and articles of manufacture described herein are not limited in this regard.

Figure 49:
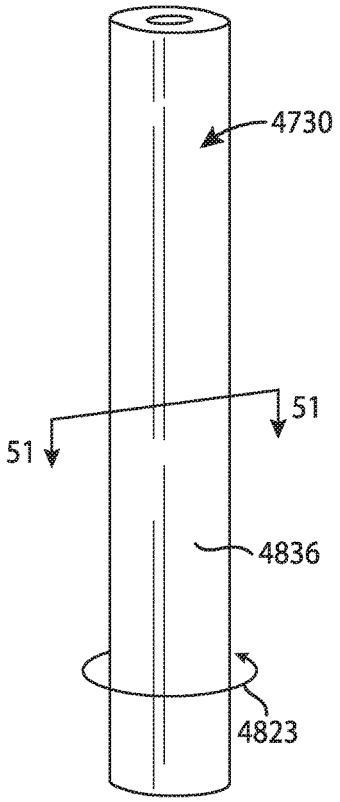
FIG. 49 depicts a side perspective view of a grip for a golf club according to an example of the apparatus, methods and articles of manufacture described herein.

The cross-sectional shape of the grip portion 4730 may define a cross-sectional grip length 4844 ($L_G$) and cross-sectional grip width 4846 ($W_G$). The grip portion 4730 may include a pair of first weight portions 4854 to increase the moment of inertia (MOI) of the golf club 4700 about the shaft axis 4722. In one example, increasing the MOI of the golf club head 4700 about the shaft axis 4722 may increase the resistance to twisting (shown by the arrow 4823 in FIG. 49) of the golf club head 4700 about the shaft axis 4722 during a stroke. Each of the first weight portions 4854 may be located at a first weight distance 4864 ($W_{d1}$) from the shaft axis 4722. Increasing the first weight distance 4864 may also increase the MOI of the golf club head 4700 about the shaft axis 4722. Accordingly, to maximize the MOI of the golf club head 4700 about the shaft axis 4722, each of the first weight portions 4854 may be located at or proximate to opposing outer surfaces 4870 of the grip portion 4730 or define at least a portion of the outer surfaces 4870, while ensuring that the size of the grip portion 4830 conforms to grip size rules established by applicable golf governing bodies such as the USGA. In other words, the first weight portions 4854 may be located as far as possible on the grip portion 4730 relative to the shaft axis 4722 while conforming to rules established by applicable golf governing bodies. The apparatus, methods, and articles of manufacture described herein are not limited in this regard.

Figure 50:
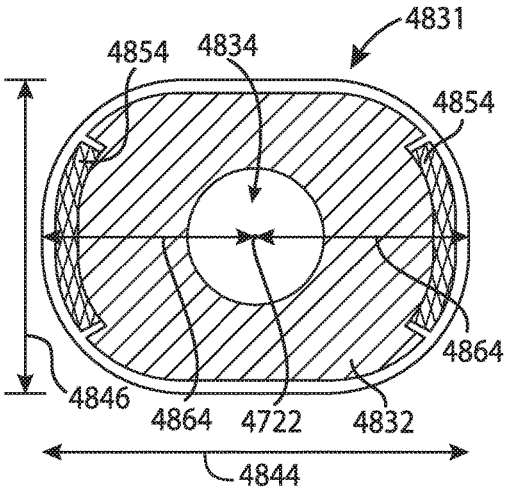
FIG. 50 depicts a cross-sectional view of the grip of FIG. 48 taken at line 50-50 of FIG. 48.
Figure 51:
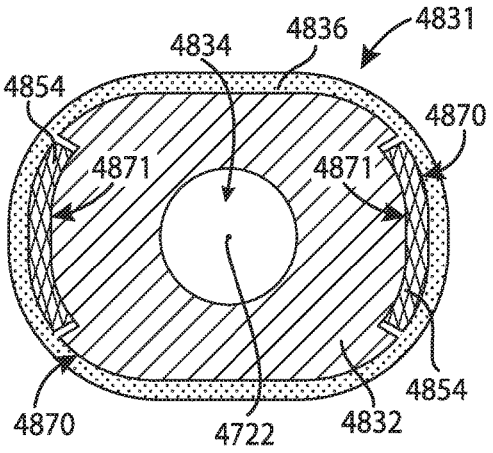
FIG. 51 depicts a cross-sectional view of the grip of FIG. 49 taken at line 51-51 of FIG. 49.

In one example, as shown in FIGS. 50 and 51, the first weight portions 4854 may be positioned in correspondingly shaped recesses 4871 defined in the grip body 4831 and located on opposite sides of the grip body 4831. Accordingly, the first weight portions 4854 may not protrude from a peripheral surface or perimeter of the grip body 4831. In one example, one or more of the first weight portions 4854 may be removably coupled or positioned inside the recesses 4871 so that the first weight portions 4854 may be easily removed and replaced with weight portions having different weight, density and/or size. Accordingly, the MOI of the golf club head 4700 about the shaft 4720 may be changed by placing heavier or lighter weight portions 4854 in the recesses 4871. In another example, one or more of the first weight portions 4854 may be fixedly attached to the recesses 4871. In yet another example, the cover portion 4736 may hold or maintain the first weight portions 4854 in the recesses 4871. The apparatus, methods, and articles of manufacture described herein are not limited in this regard.

The first weight portions 4854 in the example of FIGS. 48-51 have first weight distances 4864 that may collectively be equal to or less than the cross-sectional grip length 4844 of the grip portion 4730 so that the overall dimensions of the grip portion 4730 conforms to applicable rules of the applicable golf governing body. For example, the cross-sectional dimensions of the grip portion 4730 including the first weight portions 4854 and the cover portion 4836 may not exceed 1.75 inches to conform to the rules established by the USGA. However, the grip portion 4730 may have any dimensions and/or the weight portions may be placed at any location relative to the shaft axis 4722. The apparatus, methods, and articles of manufacture described herein are not limited in this regard.

Figure 52:
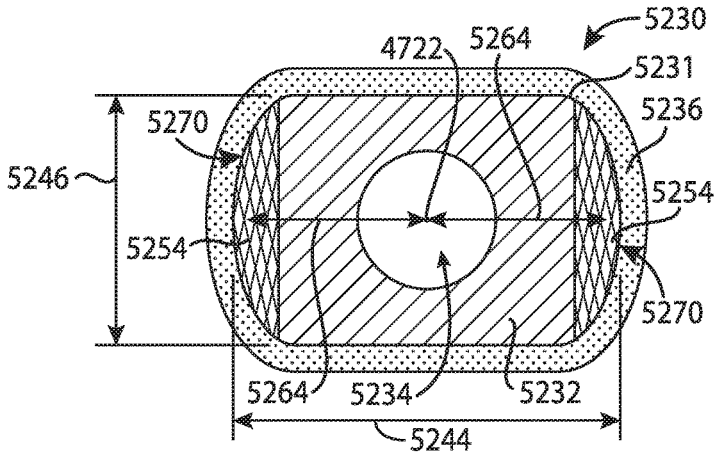
FIG. 52 depicts a cross-sectional view of a grip for a golf club according to an example of the apparatus, methods and articles of manufacture described herein.

In the example of FIG. 52, a grip portion 5230 may include grip body 5231 that may have a circular, an oval, an elliptical, or other suitable cross-sectional shape (e.g., a rectangular cross-sectional shape having rounded edges or rounded ends). The grip body 5231 may include a grip core portion 5232 with a center bore 5234 for receiving the second end portion 4726 of the shaft 4720. The grip portion 5230 may also include a grip cover portion 5236 that may cover or envelope all or portions of the core portion 5232. The grip cover portion 5236 may be similar to the grip cover portion 4836. The apparatus, methods, and articles of manufacture described herein are not limited in this regard.

The cross-sectional shape of the grip portion 5230 may define a cross-sectional grip length 5244 ($L_G$) and cross-sectional grip width 5246 ($W_G$). The grip portion 5230 may include a pair of first weight portions 5254 to increase the moment of inertia (MOI) of the golf club 4700 about the shaft axis 4722. In one example, increasing the MOI of the golf club head 4700 about the shaft axis 4722 may increase the resistance to twisting (shown by the arrow 4823 in FIG. 49) of the golf club head 4700 about the shaft axis 4722 during a stroke. Each of the first weight portions 5254 may be located at a first weight distance 5264 ($W_{d1}$) from the shaft axis 4722. Increasing the first weight distance 5264 may also increase the MOI of the golf club head 4700 about the shaft axis 4722. Accordingly, to maximize the MOI of the golf club head 4700 about the shaft axis 4722, each of the first weight portions 4854 may be located at or proximate to opposing outer surfaces 5270 of the grip portion 5230 or define at least a portion of the outer surfaces 5270, while ensuring that the size of the grip portion 5230 conforms to grip size rules established by applicable golf governing bodies such as the USGA. In other words, the first weight portions 5254 may be located as far as possible on the grip portion 5230 relative to the shaft axis 4722 while conforming to rules established by applicable golf governing bodies. The apparatus, methods, and articles of manufacture described herein are not limited in this regard.

In the example of FIG. 52, the first weight portions 5254 may be positioned at opposite outer surfaces of the grip core portion 5232. Accordingly, the first weight portions 5254 may define an overall cross sectional shape of the grip portion 5230. In the example of FIG. 52, the grip core portion 5232 may have a square or a rectangular cross-sectional shape. The first weight portions 5254 may removably or unremovably attached to the opposite sides of the grip core portion 5232. The first weight portions 5254 may have curved or circular outer surfaces. Accordingly, the overall cross-sectional shape of the grip portion 5230 may be a rectangular shape having rounded opposing sides resembling a semi-oval shape as shown in FIG. 52. The apparatus, methods, and articles of manufacture described herein are not limited in this regard.

In one example, one or more of the first weight portions 5254 may be removably coupled or positioned on the grip core portion 5232 so that the first weight portions 5254 may be easily removed and replaced with weight portions having different weight, density and/or size. Accordingly, the MOI of the golf club head 4700 about the shaft may be changed by using heavier or lighter weight portions 5254. In another example, one or more of the first weight portions 5254 may be fixedly attached to a corresponding side of the grip core portion 5232. In yet another example, the cover portion 5236 may hold or maintain the weight portions 5254 on the grip core portion 5232. The apparatus, methods, and articles of manufacture described herein are not limited in this regard.

Any cross-sectional dimension of the grip portion 5230 including the first weight portions 5254 and the cover portion 5236 may not exceed 1.75 inches to conform to the rules established by the USGA. However, the grip portion 5230 may have any dimensions and/or the weight portions may be placed at any location relative to the shaft axis 4722. The apparatus, methods, and articles of manufacture described herein are not limited in this regard.

Figure 53:
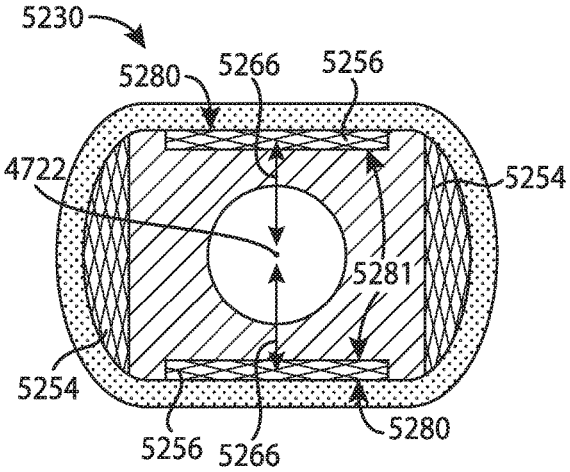
FIG. 53 depicts a cross-sectional view of a grip for a golf club according to an example of the apparatus, methods and articles of manufacture described herein.

In the example of FIG. 53, the grip portion 5230 may also include a pair of second weight portions 5256 to further increase the moment of inertia (MOI) of the golf club 4700 about the shaft axis 4722. The second weight portions 5256 may further increase the resistance to twisting (shown by the arrow 4823 in FIG. 49) of the golf club head 4700 about the shaft axis 4722 during a stroke. Each of the second weight portions 5256 may be located at a second weight distance 5266 ($W_{d2}$) from the shaft axis 4722. Increasing the second weight distance 5266 may also increase the MOI of the golf club head 4700 about the shaft axis 4722. Accordingly, to maximize the MOI of the golf club head 4700 about the shaft axis 4722, each of the second weight portions 5256 may be provided on opposing outer surfaces 5280 or define opposite outer surfaces 5280 of the grip portion 5230 while ensuring that the dimensions of the grip portion 5230 conform to grip size rules established by applicable golf governing bodies such as the USGA. In other words, the second weight portions 5256 may be located as far as possible on the grip portion 5230 relative to the shaft axis 4722 while conforming to rules established by applicable golf governing bodies. The apparatus, methods, and articles of manufacture described herein are not limited in this regard.

In one example, as shown in FIG. 53, the second weight portions 5256 may be positioned in recesses 5281 defined in the grip body 5231 located on opposite sides of the grip body 5231. In one example, one or more of the second weight portions 5256 may be removably coupled or positioned inside the recesses 5281 so that the second weight portions 5256 may be easily removed and replaced with weight portions having different weight, density and/or size. Accordingly, the MOI of the golf club head 4700 about the shaft may be changed by using heavier or lighter weight portions 5256 in the recesses 5281. In another example, one or more of the second weight portions 5256 may be fixedly attached to the recesses 5281. In yet another example, the cover portion 5236 may hold or maintain the second weight portions 5256 in the recesses 5281. The apparatus, methods, and articles of manufacture described herein are not limited in this regard.

In one example, the second weight portions 5256 may have second weight distances 5266 that collectively may be equal to or less than the cross-sectional grip width 5246 of the grip portion 5230 so that the overall dimensions of the grip portion 5230 conforms to the rules of the applicable golf governing body. For example, any cross-sectional dimension of the grip portion 5230 of FIG. 53 including the second weight portions 5256 and the cover portion 5236 may not exceed 1.75 inches to conform to rules established by the USGA. However, the grip portion 5230 may have any dimensions and/or the weight portions may be placed at any location relative to the shaft axis 4722. The apparatus, methods, and articles of manufacture described herein are not limited in this regard.

Figure 54:
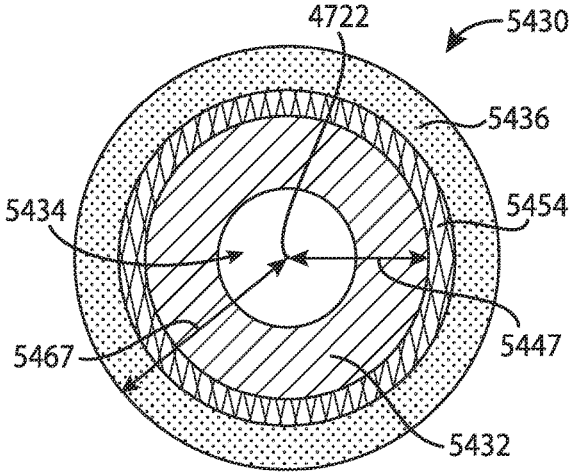
FIG. 54 depicts a cross-sectional view of a grip for a golf club according to an example of the apparatus, methods and articles of manufacture described herein.

In the example of FIG. 54, a grip portion 5430 may include a circular cross section. The grip portion 5430 may include grip core portion 5432 having a radius 5447 and a center bore 5434, a weight portion 5454, and a cover portion 5436. In one example, as shown in FIG. 54, the weight portion 5454 may surround the grip core portion 5432, and the grip cover portion 5436 may surround the weight portion 5454. Accordingly, the grip core portion 5432, the weight portion 5454, and the grip cover portion 5436 may define the overall grip portion radius 5467. As described herein, the weight portion 5454 may increase the MOI of the golf club 4700 by positioning a certain amount of mass at a distance from the shaft axis 4722, thereby increasing the resistance of the shaft 4720 to twisting about the shaft axis 4722 during a stroke. Accordingly, to maximize the MOI of the golf club head 4700 about the shaft axis 4722, the weight portion 5454 may be provided on the perimeter of the grip portion 5430 as shown in FIG. 54 while ensuring that the size of the grip portion 5430 conforms to grip size rules established by applicable golf governing bodies such as the USGA. In one example, the radius 5467, which may define an overall dimension of the grip portion 5430, may not exceed 1.75 inches to conform to rules established by the USGA. However, the grip portion 5430 may have any dimensions and/or the weight portions may be placed at any location relative to the shaft axis 4722. The weight portion 5454 may be segmented and/or have variable mass portions. Further, the weight portion 5454 may be segmented and/or have variable mass portions to provide a certain offset mass distribution relative to the shaft axis 4722. The apparatus, methods, and articles of manufacture described herein are not limited in this regard.

Any of the grip portions described herein may include any one or a combination of the first weight portions and the second weight portions. For example, the grip portion 5230 may include only one of the first weight portions 5254 on one side of the grip portion 5230 (not shown). In another example, the grip portion 5230 may include only one of the first weight portions 5254 on one side of the grip portion 5230 and only one of the second weight portion 5256 on an adjacent side of the grip portion 5230 (not shown). Accordingly, any combination of the first weight portions 5254 and the second weight portions 5256 may be used to provide a certain MOI for the golf club 4700. In another example, the first weight portions 5254 or the first weight portions 4854 may have different masses so as to provide an offset mass distribution relative to the shaft axis 4722. Similarly, the second weight portions 5456 may have different masses so as to provide an offset mass distribution relative to the shaft axis 4722. Accordingly, any number of weight portions at any one or more locations on the grip portion with or without any offset mass configurations may be used to provide a certain MOI configuration for the golf club head 4700. The apparatus, methods, and articles of manufacture described herein are not limited in this regard.

Any of the grip portions described herein may have constant or variable cross-sectional dimensions and/or shape along the length of the shaft 4720. All or portions of the grip bodies may be manufactured from a lightweight foam material and/or rubber. In one example, any of the first weight portions and the second weight portions used for a grip portion may be attached to the outer surfaces of the grip body as described herein. In another example, any of the first weight portions and the second weight portions used for a grip portion may be embedded within the grip body during the manufacturing of the grip portion. In yet another example, the grip portion may define longitudinal recesses, slots or bores in which any of the first weight portions and the second weight portions used for a grip portion may be inserted and housed. Accordingly, any of the first weight portions and the second weight portions used for a grip portion may be removable and interchangeable to provide adjustment of the MOI for the golf club 4700. Any of the first weight portions and the second weight portions used for a grip portion may be manufactured from high density materials such as steel or tungsten, and may have a density that is substantially greater than the density of the material of the grip body. In one example, any of the first weight portions and the second weight portions used for a grip portion may extend along the entire length of the grip portion. In another example, any of the first weight portions and the second weight portions used for a grip portion may extend along a partial length of the grip portion. In yet another example, any of the first weight portions and the second weight portions used for a grip portion may include a plurality of spaced apart segments that may extend along the length of the grip portion. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" or "removably coupled" is defined such that two elements that are "removably connected" or "removably coupled" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club comprising:

a golf club head having a toe portion, a heel portion, a top portion, a sole portion, a back portion, and a front portion;

a shaft having a first end portion and a second end portion, the first end portion and the second end portion defining a shaft axis, the first end portion of the shaft connected to the golf club head; and a grip portion having a grip body with a center bore for receiving the second end portion of the shaft, the grip body defining at least one recess located at an exterior portion of the grip body and extending lengthwise across a longitudinal portion of the grip body; and at least one weight portion coupled to the grip body and positioned radially outwardly from the shaft axis, the at least one weight portion located in the at least one recess, and the at least one weight portion having a cross-sectional shape defined by a linear intermediate section, a first curved section extending from one end of the linear intermediate section, and a second curved section extending from the other end of the linear intermediate section.

2. A golf club as defined in claim 1, wherein the cross-sectional shape associated with the at least one weight portion has a length that is greater than a diameter of the center bore and a uniform width that is less than a distance separating the linear intermediate section and the center bore.

3. A golf club as defined in claim 1, wherein the grip body has a bottom end and a butt end opposite the bottom end, and wherein the at least one weight portion is positioned closer to the bottom end than to the butt end.

4. A golf club as defined in claim 1, wherein the at least one weight portion comprises a material having a density that is greater than a density of a material of the grip body.

5. A golf club as defined in claim 1, wherein the at least one weight portion is positioned radially outwardly from the shaft axis by a distance of less than or equal to 1.75 inches.

6. A golf club as defined in claim 1, wherein the at least one weight portion includes a plurality of weight portions, each of the plurality of weight portions positioned radially outwardly from the shaft axis.

7. A golf club as defined in claim 1, wherein the at least one weight portion includes a plurality of weight portions, each of the plurality of weight portions positioned radially outwardly from the shaft axis, and wherein at least one weight portion of the plurality of weight portions has a mass that is different from at least one other weight portion of the plurality of weight portions.

8. A golf club as defined in claim 1, wherein the at least one weight portion is removably coupled to the at least one recess defined in the grip body.

9. A golf club as defined in claim 1, wherein the grip portion includes a grip lining, the grip lining at least surrounding the grip body and the at least one weight portion.

10. A golf club grip comprising:

a grip body configured to connect to a golf club shaft having a shaft axis, the grip body defining at least one recess located at an exterior portion of the grip body and extending lengthwise across a longitudinal portion of the grip body; and at least one weight portion coupled to the grip body and positioned radially outwardly from the shaft axis of the golf club shaft, the at least one weight portion located in the at least one recess, and the at least one weight portion having a cross-sectional shape defined by a linear intermediate section, a first curved section extending from one end of the linear intermediate section, and a second curved section extending from the other end of the linear intermediate section.

11. A golf club grip as defined in claim 10, wherein (i) the at least one weight portion comprises a material having a density that is greater than a density of a material of the grip body, and (ii) the material of the at least one weight portion comprises at least one of tungsten or steel.

12. A golf club grip as defined in claim 10, wherein the grip body includes a center bore for receiving an end portion of the golf club shaft, and wherein the at least one weight portion is positioned a maximum distance away from the center bore.

13. A golf club grip as defined in claim 10, wherein the at least one weight portion includes a pair of weight portions coupled to opposing sides of the grip body.

14. A golf grip comprising:

a grip body having a center bore for receiving an end portion of a golf club shaft, the grip body having a rounded rectangular cross-sectional shape and defining a first recess and a second recess located opposite each other at an exterior portion of the grip body and extending lengthwise across a longitudinal portion of the grip body;

a first weight portion coupled to the first recess; and a second weight portion coupled to the second recess, and wherein the first and second weight portions each have a cross-sectional shape defined by a linear intermediate section, a first curved section extending from one end of the linear intermediate section, and a second curved section extending from the other end of the linear intermediate section.

15. A golf club grip as defined in claim 14, wherein the first and second weight portions are equidistant from the center bore and are positioned to maximize a distance between each of the first and second weight portions and a shaft axis of the golf club shaft.

16. A golf club grip as defined in claim 14, wherein the cross-sectional shape associated with each of the first and second weight portions has a length that is greater than a diameter of the center bore and a uniform width that is less than a distance separating the linear intermediate section and the center bore.

17. A golf club grip as defined in claim 14, wherein the first and second weight portions are each manufactured from a material having a higher density than a density of the grip body.

18. A golf club grip as defined in claim 14 further comprising a grip lining surrounding the grip body, wherein each of the first and second weight portions is positioned between the center bore and the grip lining.

* * * * *